US006762658B1

(12) United States Patent
Isomura et al.

(10) Patent No.: US 6,762,658 B1
(45) Date of Patent: Jul. 13, 2004

(54) DIELECTRIC RESONATOR AND DIELECTRIC FILTER

(75) Inventors: Akihiro Isomura, Sendai (JP); Atsushi Furuta, Sendai (JP); Jae-Ho Hwang, Seongnam-shi (KR)

(73) Assignees: Tokin Corporation, Sendai (JP); NEC Corporation, Tokyo (JP)

( * ) Notice: Subject to any disclaimer, the term of this patent is extended or adjusted under 35 U.S.C. 154(b) by 0 days.

(21) Appl. No.: 09/807,819

(22) PCT Filed: Aug. 21, 2000

(86) PCT No.: PCT/JP00/05587

§ 371 (c)(1),
(2), (4) Date: Jul. 3, 2001

(87) PCT Pub. No.: WO01/15261

PCT Pub. Date: Mar. 1, 2001

(30) Foreign Application Priority Data

Aug. 20, 1999 (JP) ..... 11-233683
Aug. 20, 1999 (JP) ..... 11-233684

(51) Int. Cl.[7] ..... H01P 1/20
(52) U.S. Cl. ..... 333/202; 333/219.1; 333/230
(58) Field of Search ..... 333/202, 206, 333/219.1, 205, 208, 209, 223, 230

(56) References Cited

U.S. PATENT DOCUMENTS 4,028,652 A * 6/1977 Wakino et al. ..... 333/209
4,578,655 A * 3/1986 Etienne et al. ..... 333/202
4,675,630 A * 6/1987 Tang et al. ..... 333/208
4,780,691 A * 10/1988 Fiedziuszko ..... 331/9
5,764,115 A * 6/1998 Hattori et al. ..... 333/202
5,796,318 A * 8/1998 Ando et al. ..... 333/202

FOREIGN PATENT DOCUMENTS

| | | | | |
|---|---|---|---|---|
| CN | 119259 A | | 9/1998 | ..... H01P/7/10 |
| JP | 60-261201 | | 12/1985 | |
| JP | 61-79301 | * | 4/1986 | ..... H01P/1/212 |
| JP | 61-079301 | | 4/1986 | |
| JP | 61-277205 | * | 12/1986 | ..... H01P/7/10 |
| JP | 01-228301 | * | 9/1989 | ..... H01P/1/212 |
| JP | 02-241101 | * | 9/1990 | ..... H01P/1/20 |
| JP | 05-167305 | | 7/1993 | |
| JP | 09-148810 | * | 6/1997 | ..... H01P/7/10 |
| JP | 9-148810 | * | 6/1997 | ..... H01P/7/10 |
| JP | 2000-68708 | * | 3/2000 | ..... H01P/1/208 |
| JP | 2001-060804 | | 3/2001 | |

OTHER PUBLICATIONS

Japanese Office Action dated Aug. 6, 2002, with partial English translation.

* cited by examiner

*Primary Examiner*—Robert Pascal
*Assistant Examiner*—Dean Takaoka
(74) *Attorney, Agent, or Firm*—McGinn & Gibb, PLLC

(57) ABSTRACT

A dielectric resonator (10) having three surfaces formed by chamfering three ridged portions sharing an apex of a dielectric block and another three surfaces adjacent respectively thereto, in which each of the chamfered surfaces and the adjacent surfaces thereto offers an angle of 45 degrees and an area ratio of the chamfered surfaces with respect to the adjacent surfaces is 45% is mounted in a cut-off waveguide of a generally rectangular parallelopiped (21) and feeding probe (24) and (25) are provided for composing a dielectric filter.

62 Claims, 20 Drawing Sheets

DIELECTRIC RESONATOR AND DIELECTRIC FILTER

TECHNICAL FIELD

The present invention relates to a dielectric filter used in radio communications, and the like at high frequency band as microwave band; quasi-microwave band, and the like and a dielectric resonator used in the dielectric filter, and more particularly to a triple mode dielectric resonator in which three resonant modes are available in one dielectric block and a dielectric filter using the dielectric resonator therein.

TECHNICAL BACKGROUND

Conventionally, a dielectric filter which providing a cut-off waveguide with cylindrical or rectangular parallelopiped dielectrics disposing successively therein and utilizing resonance of a cylindrical TE01 δ mode or a rectangular TE11 δ mode of dielectrics is utilized widely in filters requiring low loss and size reduction, because the dielectric filter has high unloaded Q and can be reduced in size easier than waveguide type filter (a first conventional example). A resonance of the mode is generated by an electric field repeating reflections at an interface surface of the dielectric resonator and the air. The resonant frequency of dielectric resonator is inversely proportional to the length of the resonator and square root of dielectric constant, so that the larger the dielectric constant is, the smaller the resonator is. And a magnetic field generated by the resonance excites a resonator on the next stage and the excitation corresponds to the coupling between stages of the dielectric filter. As a magnitude of the coupling is mainly determined by the distance between resonators, the farther the distance is, the weaker the coupling is. As adjusting means for the above-mentioned dielectric filter, a method of adjusting the resonant frequency by a screw in a direction orthogonal to the reflecting surface of the magnetic field or a method of adjusting the coupling between the resonators by a screw, and the like are adoptable.

And there is also a dielectric filter utilizing a dual mode dielectric resonator in order to achieve size reduction (a second conventional example). The above-mentioned dielectric resonator provides two resonance by one resonator, in which a cylindrical dielectric resonator is disposed in the center of a cylindrical waveguide by justifying the axes of the cylinders, for example, and two resonance (HE11 δ) generated in two directions orthogonal to the axes of the cylinders are coupled by disturbing the electromagnetic field of the resonance from the waveguide side using means as screws, and the like.

As the description about a first conventional example above, the resonant frequency of the resonator by a cylindrical TE01 δ mode or a rectangular TE11 δ mode of dielectrics depends on dielectric constant and the size of dielectrics and a resonator can be smaller when the dielectric constant gets larger, accordingly the simplest method of reducing size of the filter utilizing the dielectric resonator is to raise the dielectric constant of dielectrics.

However, as dielectrics with low dielectric loss used in microwave region generally has a characteristic that dielectric loss thereof increases as dielectric constant becomes higher, size reduction of the filter maintaining insertion loss low has a certain limitation. Further, as dielectrics with low loss as mentioned above is expensive, accordingly the filter becomes expensive when the filter provides more stages, that is, provides more dielectrics used therein.

And a filter relative to a second conventional example utilizing HE11 δ dual mode dielectric resonator for size reduction has a problem that lots of undesired modes excited in the vicinity of pass band result in spurious characteristic deteriorated easily, because HE11 δ is not the dominant mode.

On the other hand, for example, in the event that a dielectric filter used in microwave communications, and the like is composed, it is conventionally hard to reduce size and weight of a dielectric filter, because many resonators and each spaces between the resonators occupies large amount of volume and weight according to the requirement of one resonator for one resonance and space for coupling between each resonator. Therefore, there still is a problem that the dielectric filter is unavoidably composed complicated and large, even though it is a band pass filter using dielectric resonators of relatively small size.

Consequently, composing a dielectric filter using dielectric resonators capable of multiple mode resonance is proposed to realize a band pass filter with a very small and simple composition exploiting advantages in using dielectric resonators fully. For example, size reduction of a band pass filter having a double-tuned band characteristic by varying the resonant frequency of the two resonance modes to each other is proposed in unexamined Japanese Patent Publication No. Hei 7-58516, in which degenerate coupling of two resonance modes with respect to TE101 and TE01 δ modes is disclosed (a third conventional example). And a multiple mode dielectric resonator capable of generating TM01 δ mode and TE01 δ mode which are generated on a surface parallel to each surface (x-y surface, y-z surface, x-z surface) in a rectangular coordinate system in a generally rectangular parallelopiped shaped dielectric block is proposed in unexamined Japanese Patent Publication No. Hei 11-145704 (a fourth conventional example).

However, it is still unavoidable that a dielectric resonator occupies a large amount of volume in a band pass filter requiring a resonator of multiple stages, even though the degenerate coupling of two resonance modes relative to the above-mentioned third conventional example as described in unexamined Japanese Patent Publication No. Hei 7-58516 is utilized. And even a triple mode dielectric resonator relative to the fourth example as described in unexamined Japanese Patent Publication No. Hei 11-145704 has a problem that the manufacturing process becomes complicated, because utilization of hybrid coupling of TM01 δ mode and TE01 δ mode which are orthogonal spatially requires the thickness of dielectric resonator to be adjusted to resonant frequency.

It is therefore a first object of the present invention to realize a dielectric filter capable of reducing the number of dielectric resonators to a large extent, aiming at size reduction and cost reduction and providing favorable out-of-band characteristic by incorporating the mode which has been undesired into the band and activating the mode as a portion of resonance necessary for filter characteristic exploiting advantages that unloaded Q of the dielectric filter by a cylindrical TE01 δ ode or a rectangular TE11 δ mode relative to a first and a second conventional examples is high.

And a second object of the present invention is to solve the problem of the above-mentioned third and fourth conventional examples and to provide a very small dielectric resonator with simple composition in spite of enabling a triple mode resonance and a dielectric filter using the above-mentioned dielectric resonator.

DISCLOSURE OF THE INVENTION

The present invention aims at size reduction of dielectric filter by using three resonant modes in one dielectric block in order to achieve a first object of the above-mentioned present invention. That is, in a block of a generally rectangular parallelopiped consisting of dielectric material, three resonant modes in a single dielectric block can be coupled by chamfering a ridge portion of the dielectric block and another ridge portion unparallel thereto.

That is, the dielectric resonator claimed in claim 1 is characterized in combining three resonant modes of the above-mentioned dielectric block by removing one ridge portion and another ridge portion unparallel thereto in a block of a generally rectangular parallelopiped.

It is apparent from physical symmetry characteristics that a rectangular TE11 δ mode can exist in each of three orthogonal axial direction in a block of a generally rectangular parallelopiped. In a conventional dielectric filter using TE11 δ mode or HE11 δ mode, the filter is composed using only one or two resonance out of the above-mentioned resonance of three axial direction, while the rest of the resonance exerts a harmful effect as undesired resonance. In the present invention, the rest of the resonance is utilized positively so that one resonator acts as three resonators.

And a dielectric filter claimed in claim 2 is characterized in disposing at least one dielectric resonator claimed in claim 1 in a cut-off waveguide.

Because a small dielectric filter with low insertion loss can be manufactured by composing a filter in which one or more of the above-mentioned dielectric resonators are disposed in the cut-off waveguide.

Further, a dielectric filter claimed in claim 3 is characterized in disposing two or more of the above-mentioned dielectric resonators in the above-mentioned cut-off waveguide and providing means for partition consisting of electric conductive material between the above-mentioned dielectric resonators.

Because, in the event of using plural of resonators, it becomes possible to adjust the coupling of each mode between resonators properly, to take required coupling for the pass band characteristics and to form an attenuation pole out of the pass band by providing conductive partitions between each of the resonators.

And a dielectric filter claimed in claim 4 is characterized in disposing a metal rod contacting with the above-mentioned waveguide by one end parallel to a side surface of the above-mentioned dielectric resonator in a position away from the above-mentioned side surface by a predetermined distance, in which resonant frequency of each resonance and the coupling between each of the resonance are adjustable depending on the length of the above-mentioned metal rod.

Because, a filter using a triple mode dielectric resonator according to the present invention is capable of adjusting resonant frequency and the amount of coupling by putting a metal rod as a screw from the cut-off waveguide parallel to the side surface of the dielectric resonator in the position away from the side surface of the dielectric resonator by a predetermined distance and occupying adjustable range of the filter widely by combining above-mentioned operation with conventional means for adjusting.

Incidentally, a dielectric filter claimed in claim 5 is characterized in further installing a resonator other than the dielectric resonator claimed in claim 1 in the above-mentioned waveguide as well.

Because, a small filter with an arbitrary number of stage can be composed by combining the triple mode dielectric resonator according to the present invention and resonators of dielectrics TE01 δ mode or TEM mode by metallic conductor, and the like. Besides, out-of-band characteristics all over the filter can be improved by using a resonator with less undesired resonance or with undesired resonance located away from the necessary band as the above-mentioned combined resonator.

On the other hand, in the present invention, a dielectric resonator is composed of a dielectric block of a generally rectangular parallelopiped with three ridge portions chamfered thereof and TE01 δ mode is generated on the electromagnetically individual three surfaces of the above-mentioned dielectric block as claimed in claim 6 in order to achieve the above-mentioned second object of the present invention.

Incidentally, it is preferable for the above-mentioned dielectric block to be mounted in a cut-off waveguide of a generally rectangular parallelopiped as claimed in claim 7.

And a dielectric resonator claimed in claim 8 is characterized in having three surfaces of A1, A2, A3 (hereafter called surfaces A) formed by chamfering three ridge portions sharing an apex of the above-mentioned dielectric block and three surfaces of B1, B2, B3 (hereafter called surfaces B) adjacent to each of the surfaces A respectively, in which an angle between 40 degrees and 50 degrees, both inclusive, is offered by the surfaces A and B and an area ratio of the above-mentioned surfaces A with respect to the surfaces B stands between 1% and 200%, both inclusive.

Further, a dielectric resonator claimed in claim 9 is characterized in having three surfaces A formed by chamfering three ridge portions sharing an apex of the above-mentioned dielectric block, another three surfaces of A'4, A'5, A'6 (hereafter called surfaces A') formed by chamfering three ridge portions sharing another apex on a diagonal line of the above-mentioned point, another three surfaces of B'1, B'2, B'3 (hereafter called surfaces B') adjacent to each of surfaces A and surfaces A' respectively and still another three surfaces of C'1 C'2 C'3 (hereafter called surfaces C') adjacent to each of surfaces A and surfaces A' respectively, in which an angle between 40 degrees and 50 degrees, both inclusive, is offered by the surfaces A and B' or by the surfaces A' and C' and an area ratio of the above-mentioned surfaces A with respect to the above-mentioned surfaces B' or an area ratio of the above-mentioned surfaces A' with respect to the above-mentioned surfaces C' stand between 1% and 200%, both inclusive, respectively.

On the other hand, a dielectric filter claimed in claim 10 is a dielectric filter using a dielectric resonator, in which an angle between 40 degrees and 50 degrees, both inclusive, is offered by the above-mentioned three surfaces A or A' and other three surfaces B or B' adjacent thereto respectively and the surfaces A or A' and surfaces B or B' adjacent thereto respectively have three opposing surfaces of C1, C2, C3 (hereafter called surfaces C) or the surfaces C' and characterized in providing a feeding probe near the surfaces B and B', the surfaces B' and B', the surfaces C and C', or the surfaces C' and C'.

And a dielectric filter claimed in claim 11 is a dielectric filter using a dielectric resonator having the above-mentioned three surfaces A formed by chamfering three ridge portion sharing an apex of the above-mentioned dielectric block, another three surfaces B adjacent to the above-mentioned three surfaces A forming an angle of 40 degrees through 50 degrees and three surfaces C opposing to the above-mentioned three surfaces B respectively, in which a feeding probe is provided on the surfaces B and surfaces C.

Incidentally, as a dielectric filter claimed in claim 12, an angle offered by direction p and p' of the feeding probe with respect to the x, y, z axes of the above-mentioned dielectric resonator are variable within the range of −45 degrees through +45 degrees while in use.

And as a dielectric filter claimed in claim 13, frequency and attenuation generating the attenuation pole at a lower side band can be varied by varying a position for providing a feeding probe on the above-mentioned surfaces B and a position for providing a feeding probe on the above-mentioned surfaces C respectively.

Here, either of rod-type as claimed in claim 14 or loop-type as claimed in claim 15 is acceptable as the above-mentioned feeding probe.

Further, as claimed in claim 16, a dielectric filter capable of being applied to various kinds of application can be composed by mounting two or more of the above-mentioned dielectric resonators in the above-mentioned cut-off waveguide of a generally rectangular parallelopiped therein.

PREFERRED EMBODIMENT FOR CARRYING OUT THE PRESENT INVENTION

Figure 1:
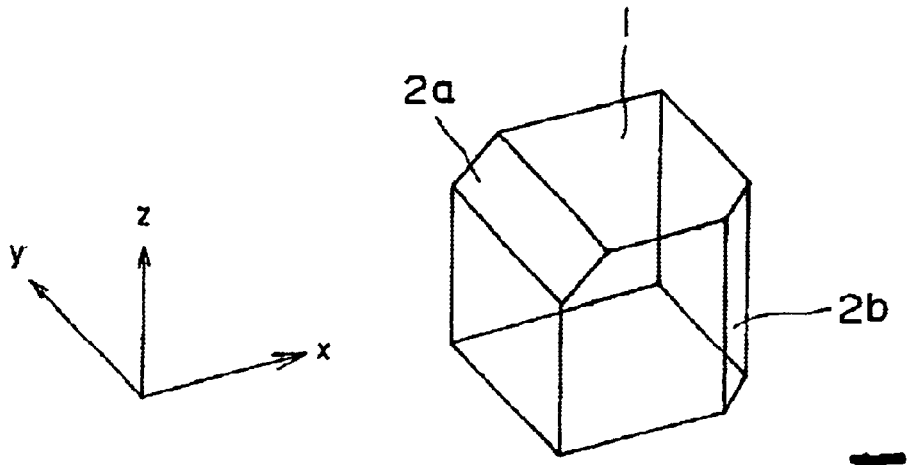
FIG. 1 is a perspective diagram for showing a triple mode dielectric resonator relative to a first preferred embodiment of the present invention.

Referring to the drawings, explanation will be made for describing the present invention in detail, as follows.

At first, a first preferred embodiment of the present invention is described. FIG. 1 is a perspective diagram for showing a triple mode dielectric resonator relative to a first preferred embodiment of the present invention. The triple mode dielectric resonator relative to the present preferred embodiment is composed of combination of three resonant modes in one dielectric block 1 by having a surface 2*a* formed by chamfering a ridge portion of a dielectric block 1 of a generally rectangular parallelopiped and a surface 2*b* formed by chamfering another ridge portion which is not parallel to the above-mentioned ridge portion. Incidentally, though axes x, y, z is shown separately from the dielectric block 1 in FIG. 1, the axes x, y, z are in a relation to be orthogonal to each of two surfaces of the dielectric block 1 of a generally rectangular parallelopiped. And the relation is taken over in the following drawings.

Figure 2:
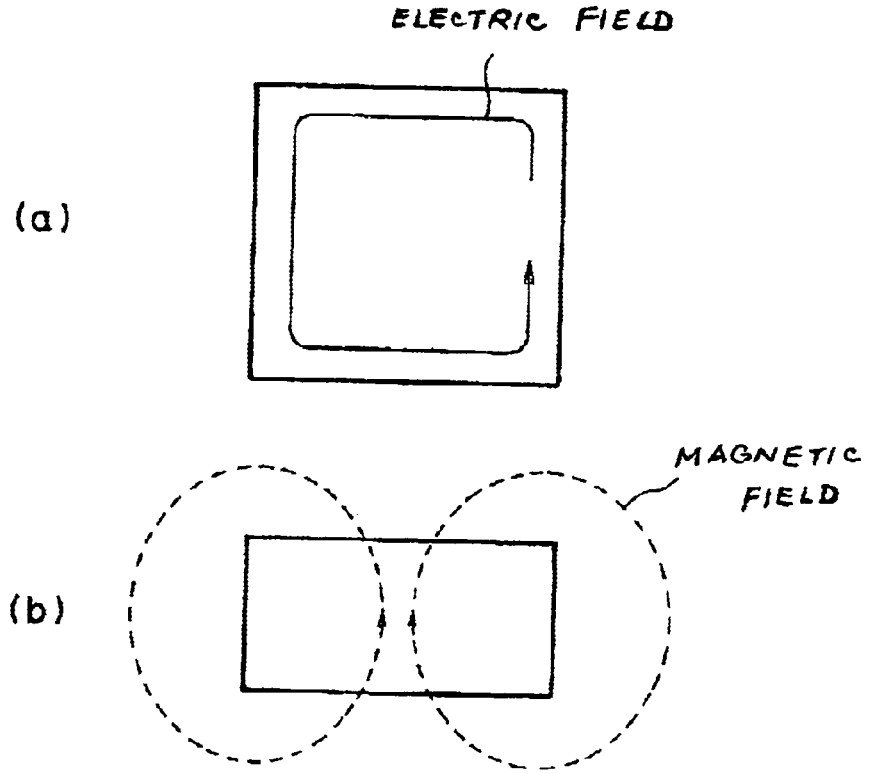
FIG. 2 is a diagram for illustrating resonance of rectangular TE11 δ mode, (a) is indicating a direction to which an electric field acts and (b) is indicating a direction to which a magnetic field acts respectively.
Figure 3:
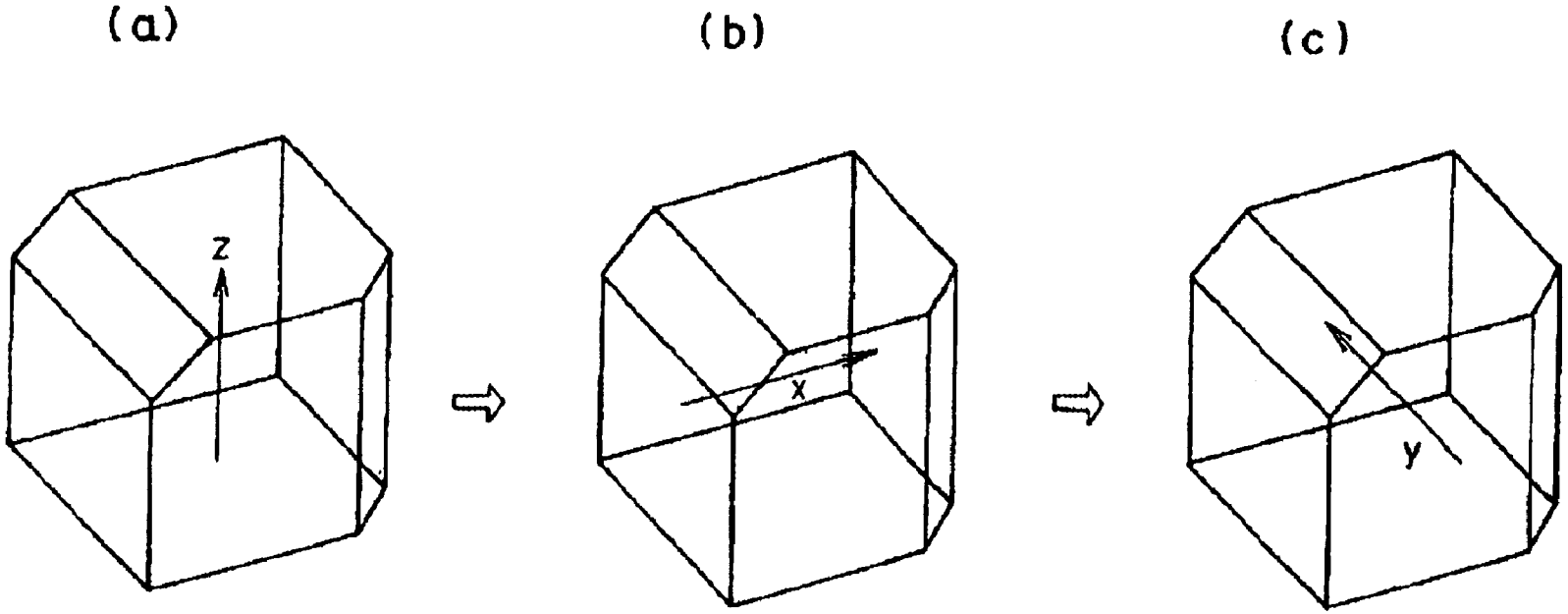
FIG. 3 is a diagram for illustrating the principle of a resonator which excites three resonance successively, (a) is indicating resonance of a direction z is on a first stage of a filter, (b) is indicating resonance in a direction x on a second stage and (c) is indicating resonance in a direction yon a third stage.

That is, now, in the orthogonal x-y-z coordinate system, the electric field is excited initially so that a direction z corresponds to a propagation direction of TE wave. Then an electric field repeats reflections in the direction z by 180-degrees reflection of the electric field at an interface surface of the dielectrics and the air and excites resonance of rectangular TE11 δ mode at a certain frequency shown in FIGS. 2(*a*) and (*b*). However, as shown in FIG. 1, when the dielectric block 1 has the surface 2*a* which is formed by chamfering a ridge portion parallel to the axis y, a tangent component (component y) of the electric field reflects in a 90-degrees direction on the surface 2*a* and propagates in the direction x. That is, component y in the propagation direction z reflects on the surface 2*a* and becomes component y in the propagation direction x. Electric wave generated in the direction x also repeats reflections at the interface surface similar to the direction z and excites resonance. According to the similar principle, when the dielectric block 1 has the surface 2*b* which is formed by chamfering a ridge portion parallel to the axis z, resonance in the direction y is excited and three resonance are excited successively by one resonator. What described above is the principle of the combination. Though the actual electric field in a resonator are degenerated so that components in three directions can exist concurrently, it is understandable that the direction z is on a first stage, as shown in FIG. 3(*a*), the direction x is on a second stage, as shown in FIG. 3(*b*), the direction y is on a third stage, as shown in FIG. 3(*c*). When the dielectric block is a cube, resonant frequency on the second stage is raised higher. For adjusting three resonance frequencies, the size of the dielectric block 1 can be shortened on the second stage, that is, in the direction x. And with regard to the coupling, it can be understood that the surface 2*a* with a chamfered ridge portion is a coupling of the first and the second stages and the surface 2*b* with a chamfered ridge portion is a combination of, the second and the third coupling.

Figure 4:
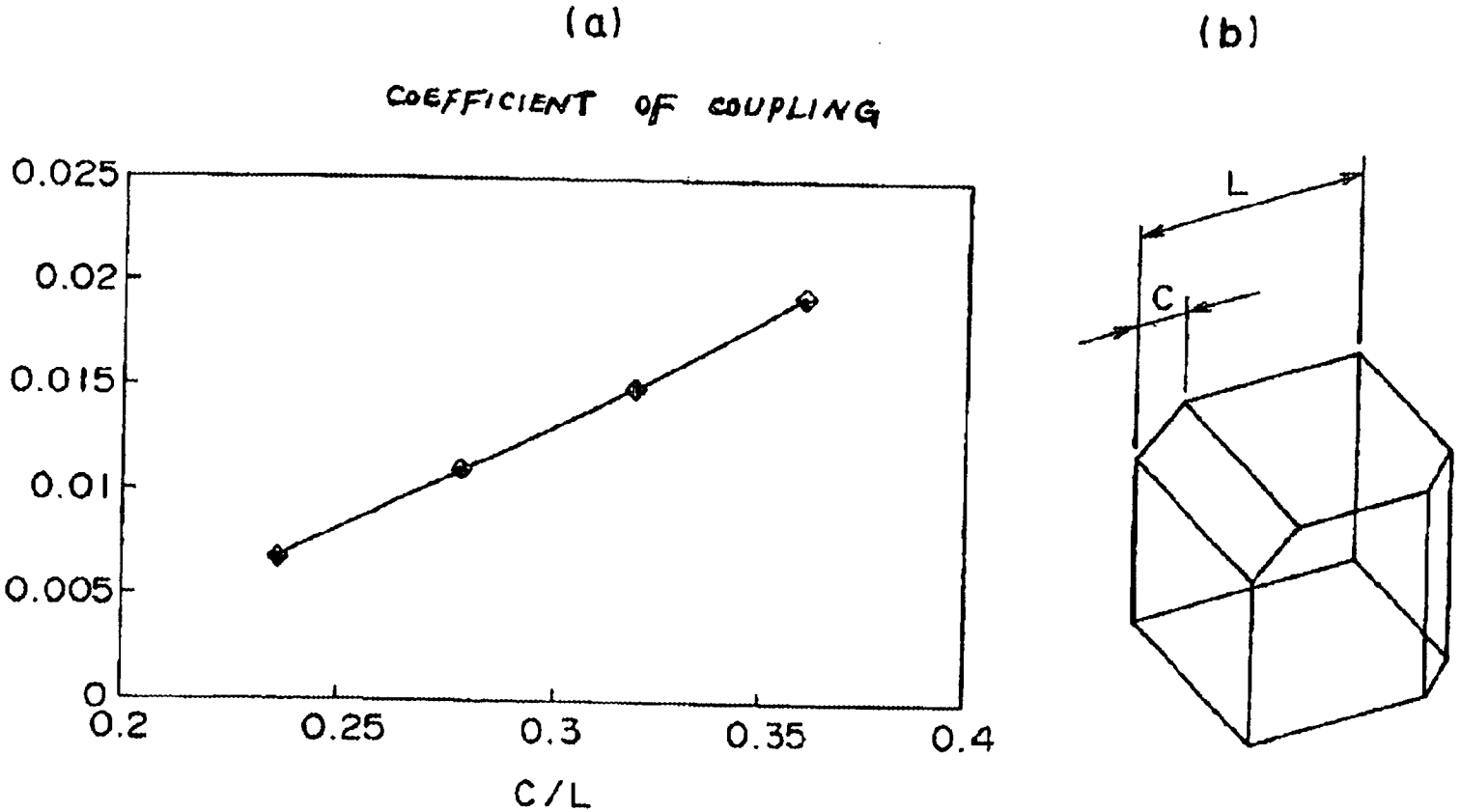
FIG. 4 is a diagram for illustrating how the coupling can be varied in the event of varying the size of the ridge portion to be chamfered, (a) is showing a graph indicating the result and (b) is showing how to take a size C of the ridge portion to be chamfered and a size L of whole surface including the above-mentioned chamfered portion.

The result of checking for how the coupling varies in the event of changing the size of chamfering the above-mentioned ridge portion is shown in FIG. 4. Here, by taking a size C of the chamfered ridge portion of the dielectric block 1 of a generally rectangular parallelopiped and a size L of the whole surface including the chamfered portion, variation of coefficients of coupling is checked for in four events of varying C/L. As shown in FIG. 4(*a*), as an occupied rate of the size L of the whole by the size C of the chamfered ridge portion goes up, so does the coefficients of the coupling monotonously. Therefore, the coupling can be intensified, as the size of the chamfered ridge portion is taken larger in the dielectric block 1.

EXAMPLE 1

Figure 5:
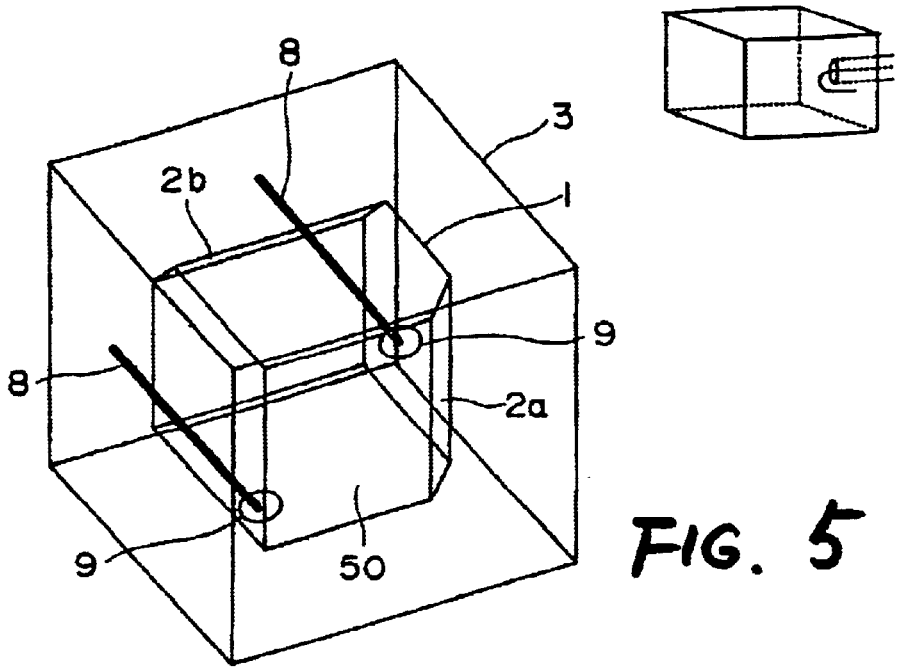
FIG. 5 is a perspective diagram for showing a dielectric filter of the example 1 utilizing a triple mode dielectric resonator.
Figure 6:
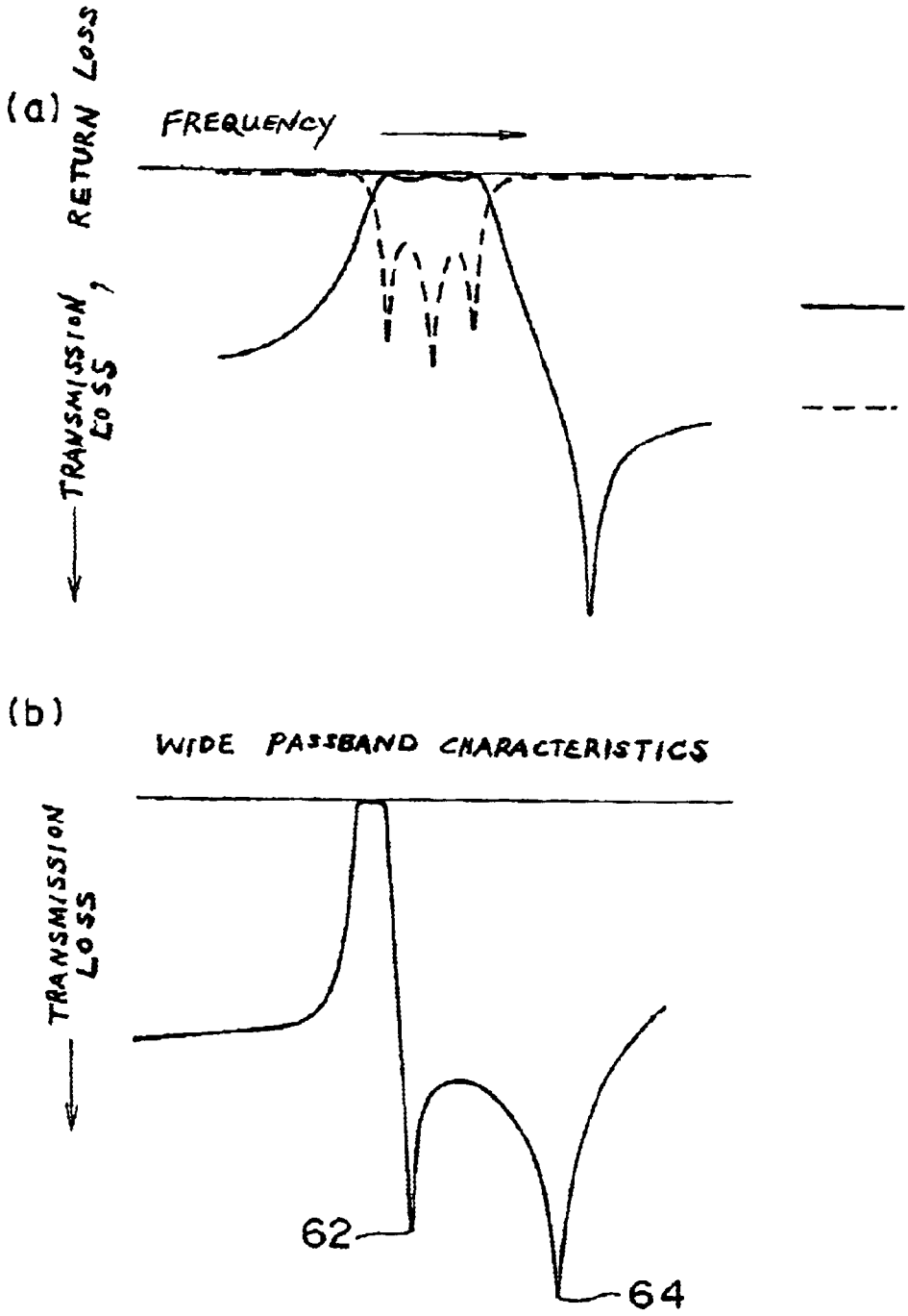
FIG. 6 is a diagram for showing an example of characteristics of the dielectric filter shown in FIG. 5, (a) is showing a relation between insertion loss and return loss with frequency and (b) is showing a wide band characteristics of transmission loss.

FIG. 5 is a perspective diagram of a dielectric filter of an example 1 in which one of the above-mentioned triple mode dielectric resonator is used. That is, as shown in FIG. 5, the dielectric filter of the present example is composed of a triple mode dielectric resonator 50 disposed in a cut-off wave guide 3, in which three resonant modes of a dielectric block 1 of a generally rectangular parallelopiped are coupled by forming a surface 2*a* by chamfering a ridge portion and a surface 2*b* by chamfering a ridge portion on the dielectric block 1 and two rod-type antennas 8, 8 having a tip respectively opened by input-output terminals 9, 9 are provided as means for excitation. In the dielectric filter of the example 1, the antennas 8, 8 with an open tip are used as means for excitation of the dielectric resonator 50. Actually, the dielectric resonator 50 is supported by dielectrics with low dielectric constant, and the like in order not to contact with the cut-off waveguide 3, while the dielectrics with low dielectric constant is abbreviated in the present diagram. Characteristics example of the dielectric filter shown in FIG. 5 is shown in FIGS. 6(*a*) and (*b*). As shown in FIG. 6(*a*), three poles of return loss appear and that indicates characteristics corresponding to the characteristics of a filter with three stages is obtained. And as shown in FIG. 6(*b*), it is apparent that two attenuation poles 62, 64 are generated on a side of higher frequency than center frequency.

The inset in FIG. 5 shows exemplarily a feeding probe as being a loop-type probe rather than a rod-type probe. FIG. 11A additionally shows the loop-type feeding probe 8 as specifically incorporated in an exemplary embodiment of the present invention.

COMPARATIVE EXAMPLE 1

Figure 7:
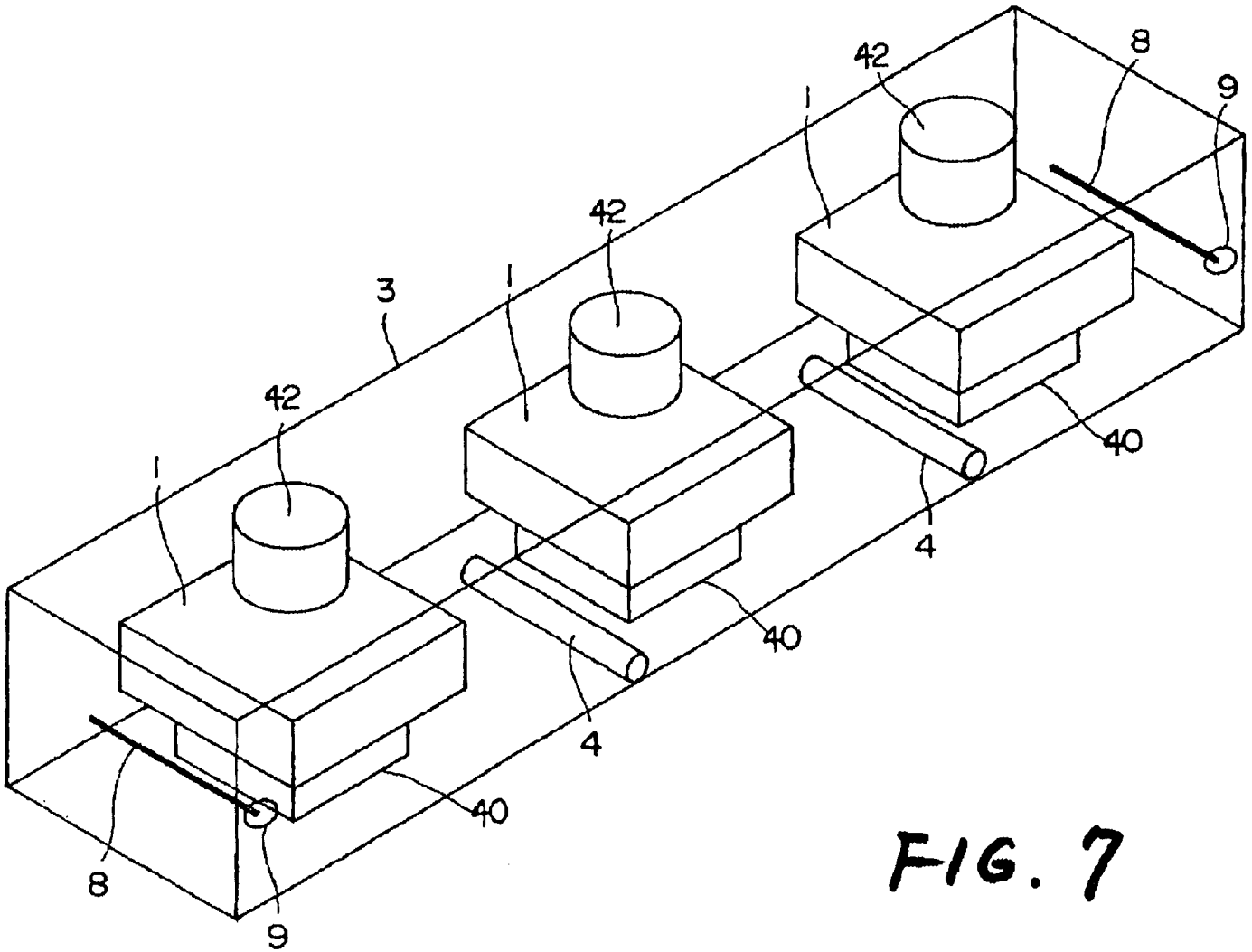
FIG. 7 is a perspective diagram for showing a comparative example 1 of a dielectric filter with three stages utilizing conventional TE11 δ mode.

FIG. 7 is a perspective diagram for showing a comparative example 1 of a dielectric filter with three stages using a conventional TE11 δ mode. That is, the dielectric filter of the comparative example 1 is composed of three dielectric blocks 1 putting a predetermined distance to each other disposes in a longitudinal cut-off waveguide 3 and rod-type antennas 8, 8 having a tip respectively opened by input-output terminals 9, 9 provided as means for excitation at both ends in a longitudinal direction of the cut-off waveguide 3. And screws 4, 4 having one end respectively contacting with the cut-off waveguide 3 are disposed between each of three dielectric blocks 1 in order to adjust the coupling between the dielectrics. Incidentally, 40 indicates mounts for supporting each resonator (dielectric block 1) and resonant frequency of each resonator (dielectric block 1) is adjusted by each metal rod 42.

With regard to volume of the dielectric block 1, the dielectric filter according to the example 1 shown in FIG. 5 is larger to some extent than the one according to the comparative example 1 shown in the above-mentioned FIG. 7, though a certain amount of distance corresponding to the coupling is required between a dielectric block 1 and another dielectric block 1, as shown in FIG. 7. As characteristics corresponding to a filter with triple stages can be obtained by one dielectric block 1 in the dielectric filter according to the example 1 shown in FIG. 5, the above-mentioned distance is not required and the volume of whole filter is possibly one third of the comparative example 1. As mentioned above, in the example 1, it is possible for realizing a small dielectric filter using a triple mode dielectric resonator.

COMPARATIVE EXAMPLE 2

Figure 8:
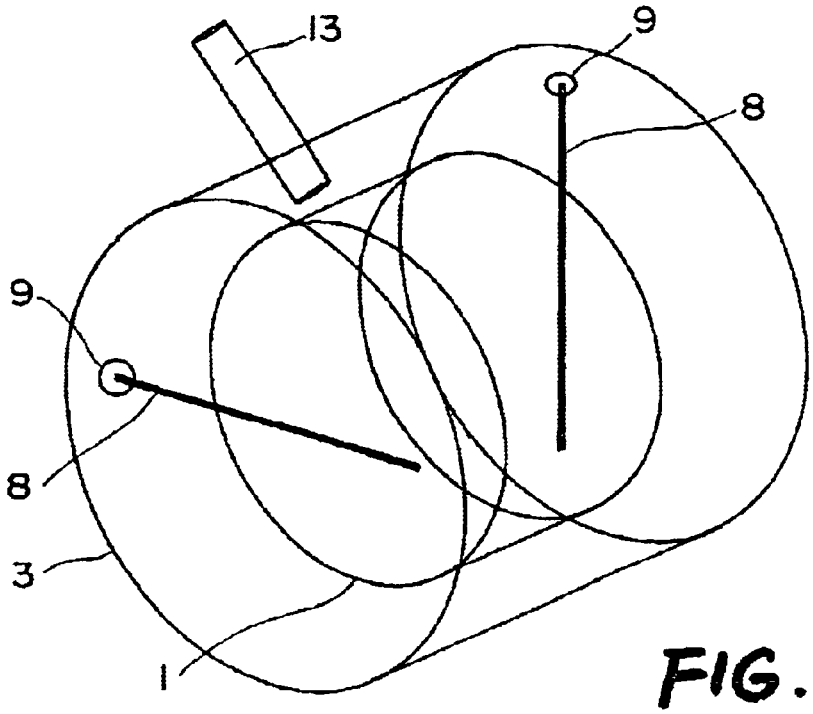
FIG. 8 is a perspective diagram for showing a comparative example 2 of a dielectric filter utilizing conventional HE11 δ dual mode.
Figure 9:
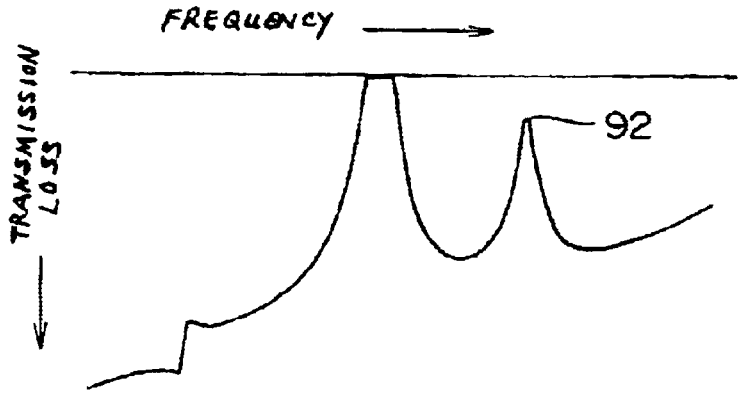
FIG. 9 is showing pass band characteristics of the dielectric filter of the comparative example 2 shown in FIG. 8.

FIG. 8 is a perspective diagram for showing a comparative example 2 of a dielectric filter using a conventional HE11 δ dual mode. That is, the dielectric filter is composed of a cylindrical dielectric block 1 supported by dielectrics with low dielectric constant, and the like (not shown) in order not to contact with a cut-off waveguide 3 disposed in the cylindrical cut-off waveguide 3 and rod-type antennas 8, 8 having a tip respectively opened by input-output terminals 9, 9 provided at both ends of the cut-off waveguide 3 varying the angles to each other. Two resonance in the dual mode dielectric resonator are adjusted with the coupling by a metal rod 13. Pass band characteristics of the dielectric filter of the comparative example 2 shown in FIG. 8 are shown in FIG. 9. Incidentally, FIG. 9 shows the same band as the FIG. 6.

As shown in reference numeral 92 of FIG. 9, undesired resonance is excited near the high frequency side of the pass band in the dielectric filter of the comparative example 2. On the contrary, in the dielectric filter according to the example 1 mentioned above, abrupt attenuation poles 62, 64 are generated on the high frequency side of the pass band, which appears the dielectric filter has excellent characteristics as a filter.

EXAMPLE 2

Figure 10:
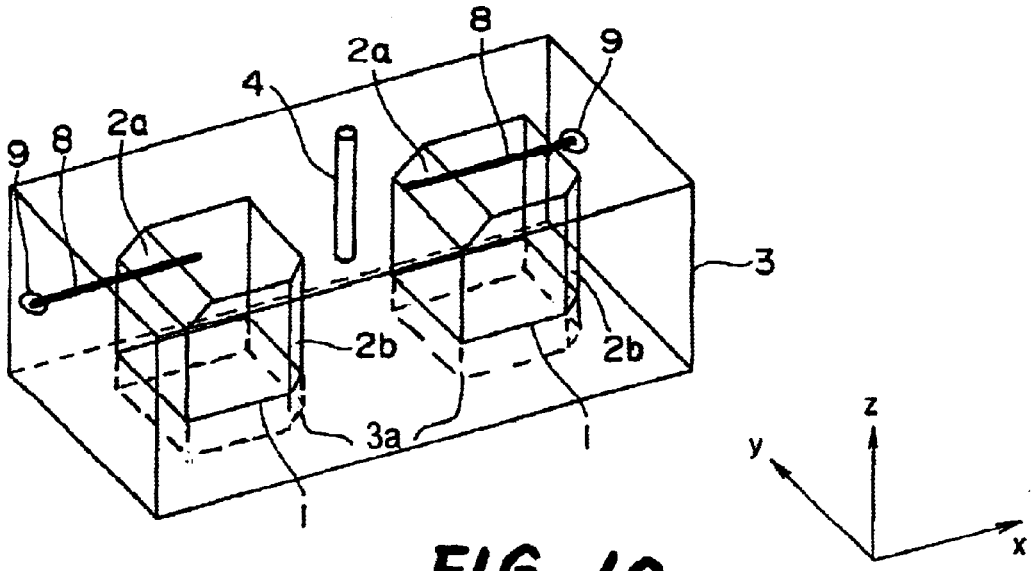
FIG. 10 is a perspective diagram for showing a dielectric filter of an example 2 utilizing two triple mode dielectric resonators.

FIG. 10 is a perspective diagram of a dielectric filter of an example 2 utilizing two of the above-mentioned triple mode dielectric resonators therein. That is, the dielectric filter of the example 2 is composed of two of the triple mode dielectric resonators shown in FIG. 1 putting a predetermined distance to each other disposed in a longitudinal cut-off waveguide 3 and rod-type antennas 8, antennas 8 having both end surfaces opened by input-output terminals 9, terminals 9 provided in a direction of axis x from the above-mentioned both end surfaces in longitudinal direction of the cut-off waveguide 3 respectively. A screw 4 contacting with upper surface of the cut-off waveguide 3 by one end is disposed between the two triple mode dielectric resonators in order to adjust the coupling between the dielectrics. Exemplary mounts 3*a* for supporting each resonator (dielectric block 1) are shown.

In the dielectric filter of the example 2, two of the triple mode dielectric resonators are provided, which makes totally six stages of filter. In FIG. 10, a metal rod (screw) 4 is inserted between the resonators in order to couple the two dielectric resonators strongly by resonance in the direction y.

EXAMPLE 3

Figure 11:
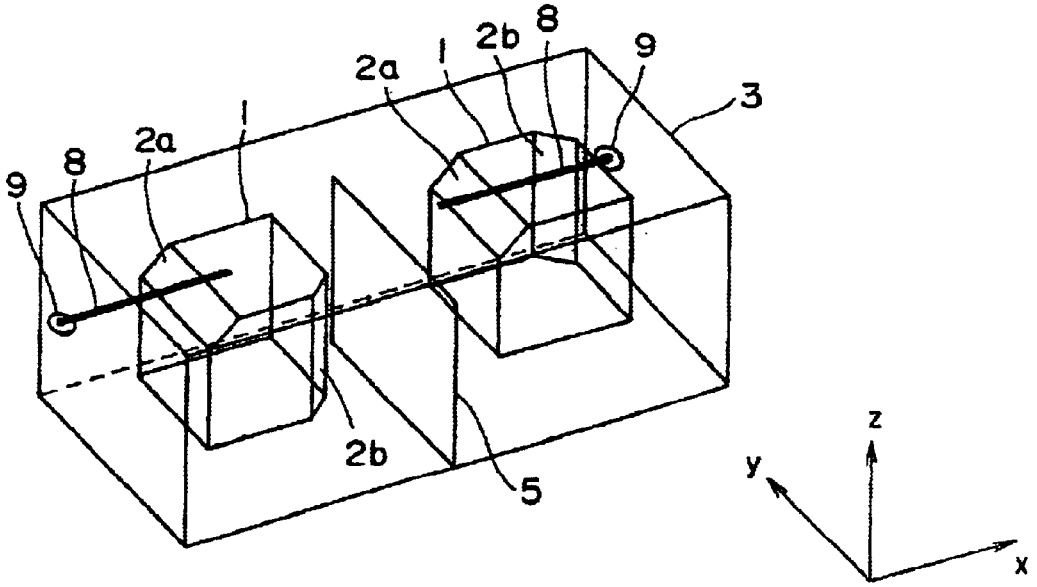
FIG. 11 is a perspective diagram for showing a dielectric filter of an example 3 providing a dielectric filter utilizing two triple mode dielectric resonators with a metallic partition between two dielectric blocks.
Figure 11A:
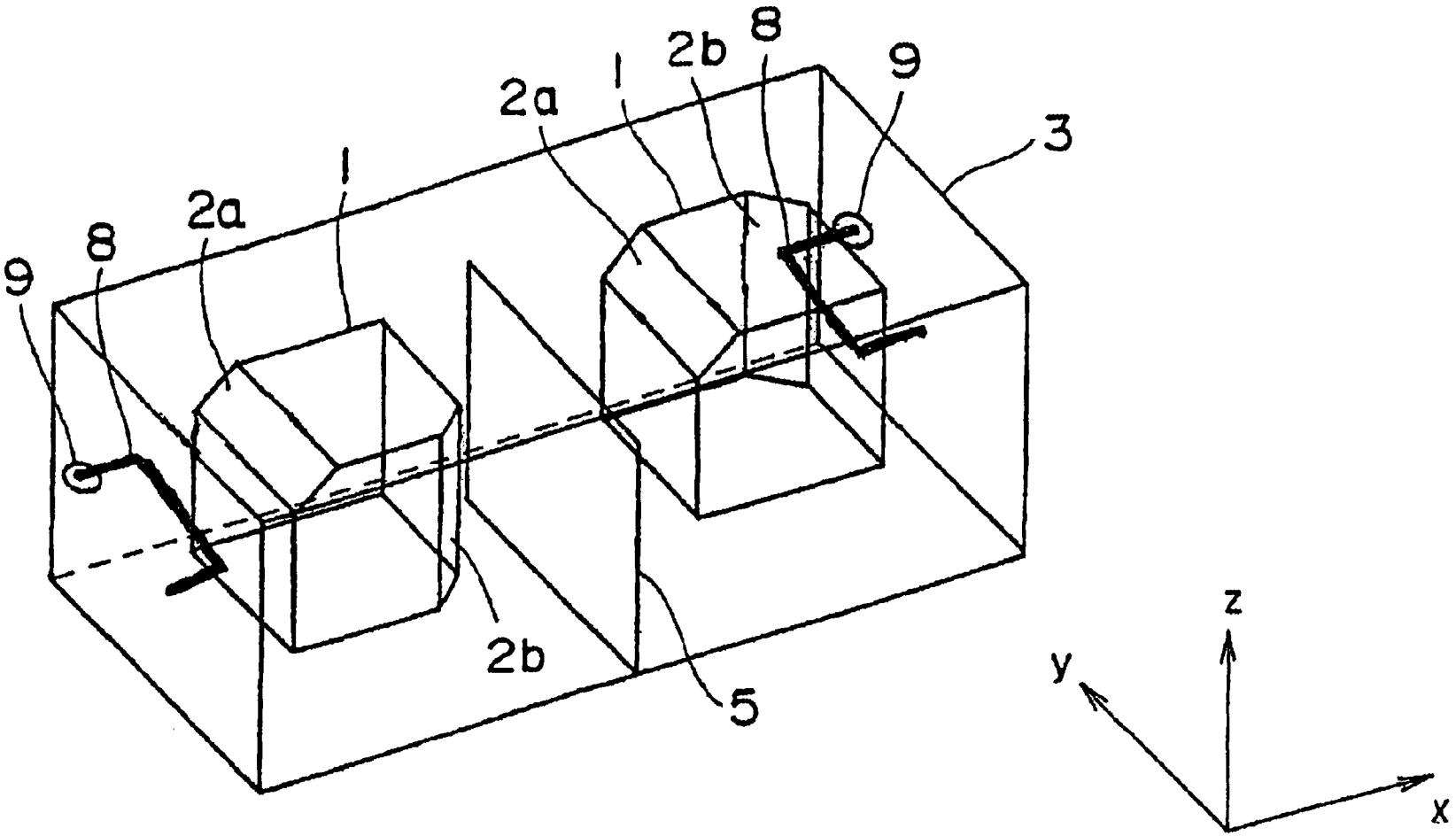
FIG. 11A shows the dielectric filter of FIG. 11 as configured using a loop-type feeding probes 8.

FIG. 11 is a perspective diagram of a dielectric filter of an example 3 which is a dielectric filter utilizing the above-mentioned triple mode dielectric resonators providing a metallic partition 5 between two dielectric blocks 1 therein. That is, in the same manner as the above-mentioned example 2, the dielectric filter of the example 3 is composed of two of the triple mode dielectric resonators shown in FIG. 1 disposed in a longitudinal cut-off waveguide 3 and rod-type antennas 8, 8 having both end surfaces opened by input-output terminals 9, 9 provided in a direction of axis x from the above-mentioned both end surfaces in longitudinal direction of the cut-off waveguide respectively. In the present example, a metallic partition 5 is provided instead of a screw 4 of the example 2 between the two dielectric resonators. And as shown in FIG. 11, a surface 2*b* having the above-mentioned another ridge portion chamfered on one side of the dielectric block 1 is formed in a different position from the surface of the example 2 shown in FIG. 10. Incidentally, mounts for supporting each resonator (dielectric block 1) are abbreviated in the present diagram as well.

Figure 12:
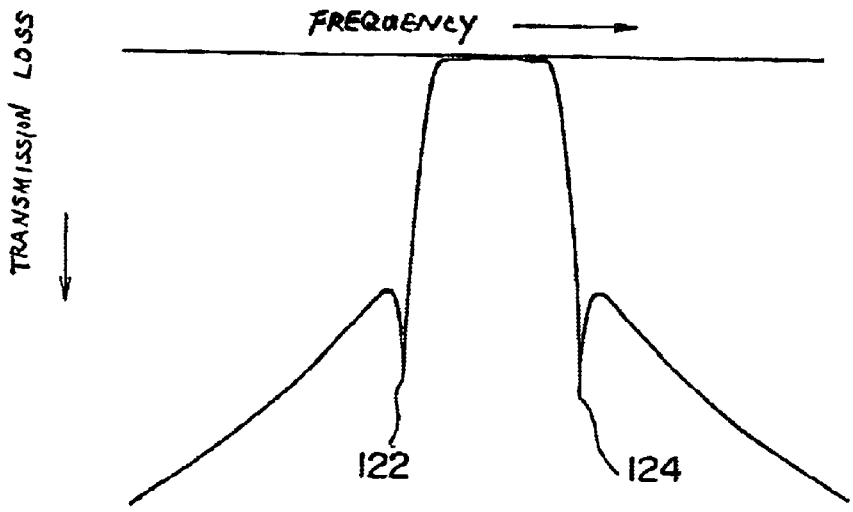
FIG. 12 is a diagram for showing a frequency characteristic of the dielectric filter shown in FIG. 11.

A frequency characteristic of the dielectric filter is shown in FIG. 12. In the dielectric filter of the example 3, a coupling between resonators by resonance in direction x and direction z can be weakened by the metallic partition 5 and the coupling between the resonators can be mainly obtained by the resonance in direction y. And it is possible for providing an attenuation pole in any position arbitrarily by varying the position of the metallic partition 5 and the direction of each dielectric block 1. As shown in FIG. 12, attenuation poles 122, 124 can be provided respectively on both of low frequency side and high frequency side of the pass band by using a shape of resonator of the example 3 shown in FIG. 11, means for excitation and metallic partition 5.

EXAMPLE 4

Figure 13:
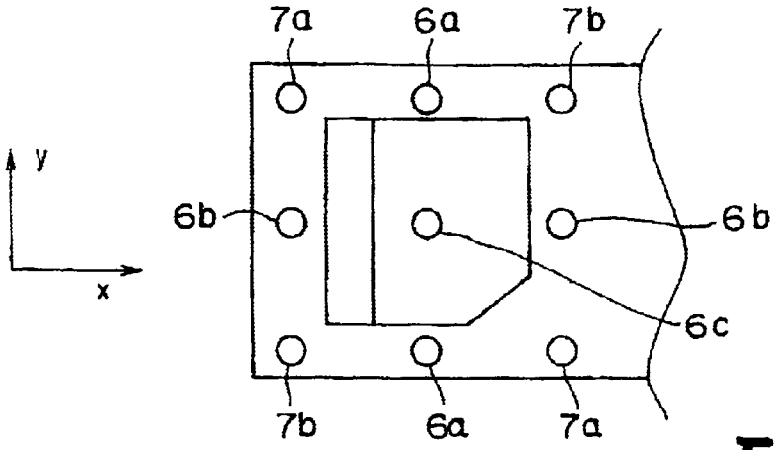
FIG. 13 is a diagram showing a method of adjusting the dielectric filter by using a metal rod.

FIG. 13 is a diagram for showing a method of adjusting the above-mentioned dielectric filter by a metal rod. Actually, a screw is used as a metal rod and the adjustment is conducted by putting in and out of the screw. The metal rod acts on a magnetic field leaking from dielectrics. As the metal rod in the position of 6*a* in FIG. 13 has interlinkage with magnetic flux of the resonance in the event of resonance in direction x, the magnetic field is intensified and resonant frequency becomes lower. The phenomenon is equal to a growth of equivalent inductance in a parallel resonant circuit. In the same manner, 6*b* lowers the resonant frequency of y direction. Conventionally, as a metal rod in a position of 6*c* raises the resonant frequency, frequency can be adjusted in wide range by combination of the adjustment in the three directions x, y, z. With regard to the coupling, as 7*a* weaken the coupling of resonance in direction x and in direction y while 7*b* works for intensifying the coupling, adjustable range is wide. As mentioned above, because of a post-adjustment by using a metal rod, a precision required for sizes or dielectric constant of a dielectric block in manufacturing a resonator can be alleviated and manufacturing cost can be saved in the result.

EXAMPLE 5

Figure 14:
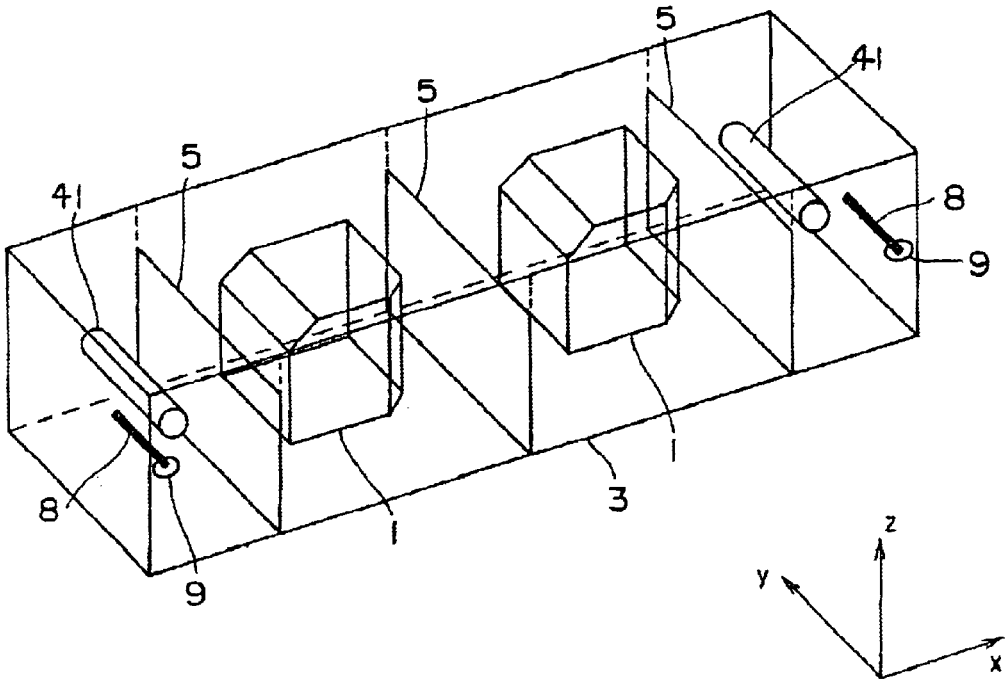
FIG. 14 is a perspective diagram for showing a dielectric filter with eight stages relative to the example 5 consisting of a combination of a triple mode dielectric resonator of the present invention and a metallic TEM mode resonator.

FIG. 14 is a perspective diagram for showing a dielectric filter with eight stages composed of combination of a triple mode dielectric resonator of the present invention and a TEM mode resonator made of metal relative to an example 5. That is, the dielectric filter of the example 5 is composed of two of the triple mode dielectric resonators shown in FIG. 1 putting a predetermined distance to each other disposes in a cut-off waveguide 3 and a TEM mode resonator 41 made of metal disposed on both sides of the resonators. Incidentally, rod-type antennas 8, 8 opened by input-output terminals 9, 9 are provided in a direction of axis y at both end portions of the cut-off waveguide 3. In the present invention, totally three metallic partitions 5 are provided between the two triple mode dielectric resonators and between each triple mode dielectric resonator and the TEM mode resonator 41. Incidentally, mounts for supporting each resonator are abbreviated in the present diagram as well. When a filter is manufactured by using only a triple mode dielectric resonator, the filter can be composed of stages by multiples of three, however, a filter composed of stages of arbitrary numbers can be composed by combining the triple mode dielectric resonator of the present invention and, for example, a resonator of single TE01 δ mode of dielectrics according to a prior art, and the like. And as shown in FIG. 14, undesired resonance can be suppressed by combing the TEM mode resonator 41 instead.

Next, a second preferred embodiment of the present invention will be described as follows.

Figure 15:
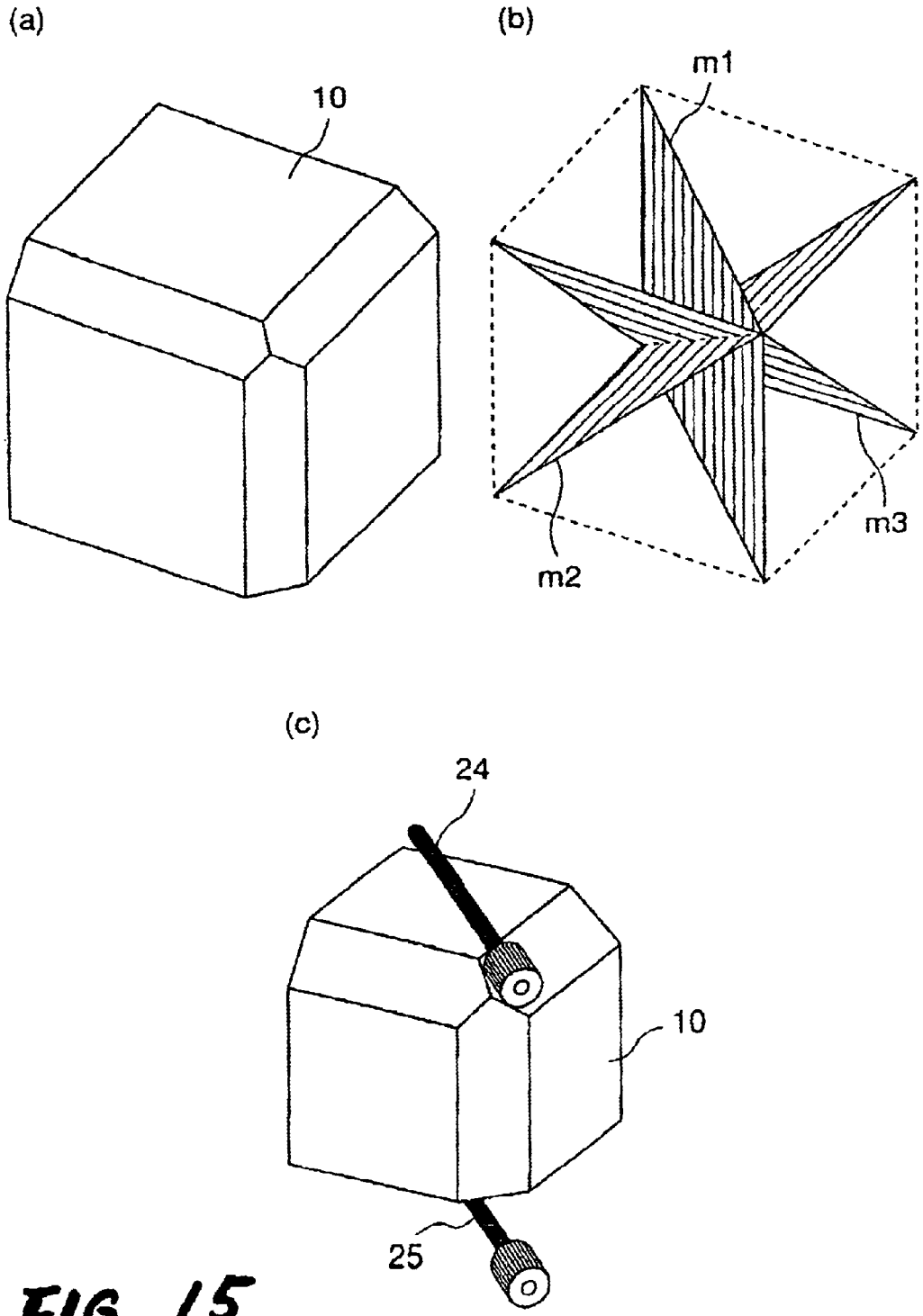
FIG. 15 is a diagram for illustrating a triple mode dielectric resonator relative to a second preferred embodiment of the present invention, (a) is a diagram for showing a basic composition of the triple mode dielectric resonator, (b) is a diagram for showing planes existing each electric field of the triple mode resonance in the dielectric resonator and (c) is a diagram for showing a method of exciting a single mode (in other word, exciting in a degenerated state) in the dielectric resonator.

FIG. 15(*a*) is a diagram for showing a fundamental composition of a triple mode dielectric resonator relative to the second preferred embodiment of the present invention and FIG. 15(*b*) is a diagram for showing planes existing each electric field of the triple mode resonance in the dielectric resonator shown in FIG. 15(*a*).

As shown in FIG. 15(*a*), the dielectric resonator 10 of the present preferred embodiment consists of dielectric blocks generally cube-type with three ridge portions chamfered and characterized in generating TE01 δ mode in electro-magnetically independent three surfaces m1, m2, m3 of the dielectric block, as shown in FIG. 15(*b*). Incidentally, the electro-magnetically independent three resonant modes are generated on each surface of m1, m2, m3 and an angle of 60.0 degrees is offered between each surface of m1, m2, m3, in FIG. 15(*b*).

FIG. 15(*c*) is a diagram for showing a method of exciting a single mode (in other word, exciting in the degenerated state) in the dielectric resonator shown in FIG. 15(*a*). As shown in FIG. 15(*c*), feeding probes 24 and 25, for example, are disposed in the same direction on an opposing surface to the dielectric block to excite a single mode.

Figure 16:
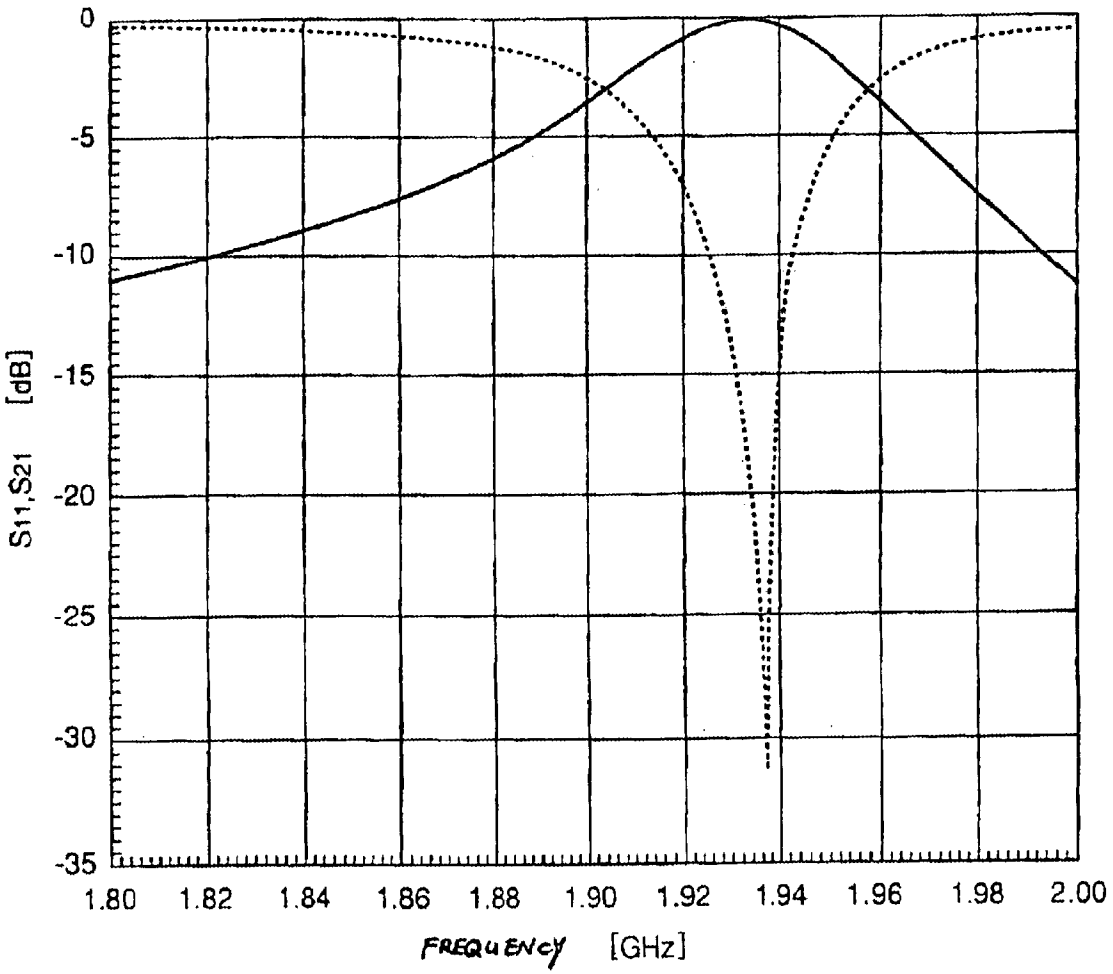
FIG. 16 is a diagram for showing pass band characteristics and return loss in the event of exciting a single mode (in other word, exciting in a degenerated state) as shown in FIG. 5(*c*)

FIG. 16 is a diagram for showing pass band characteristics in the event of exciting only a single mode (in other word, exciting in the degenerated state), as FIG. 15(*c*). In FIG. 16, the pass band characteristics in the above-mentioned event is indicated by a solid line and return loss is indicated by a dotted line respectively.

As it is apparent from FIG. 16, all three resonant modes are TE01 δ mode and have the similar resonant frequency of approximately 1.935 [GHz] in the triple mode dielectric resonator of the present preferred embodiment.

EXAMPLE 6

Figure 17:
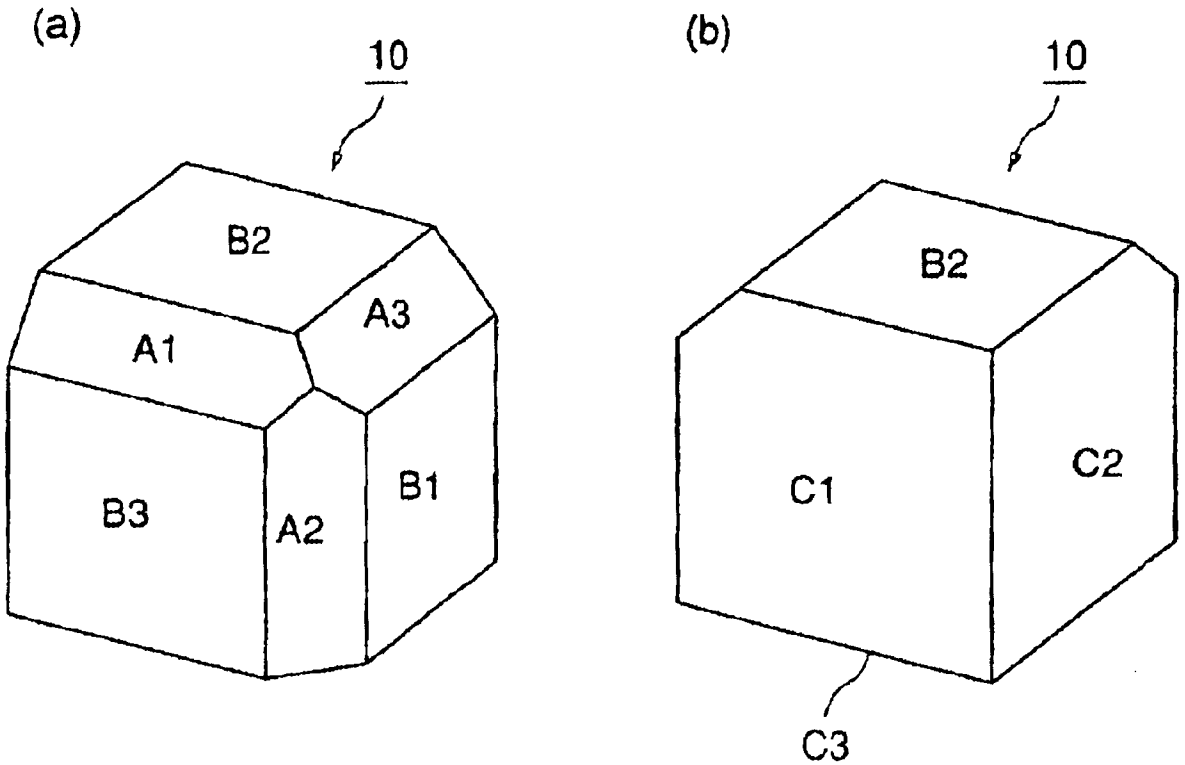
FIG. 17 is a diagram for showing a dielectric resonator of an example 1, (a) is a perspective view of the dielectric resonator observed from a certain point of view and (b) is a perspective view of the dielectric resonator observed from another point of view.

Dielectric resonators of the present example are shown in FIGS. 17(*a*) and (*b*). FIGS. 17(*a*) and (*b*) are diagrams for showing the same dielectric resonator 10 observed from different viewpoints respectively. Incidentally, a dielectric block consisting of dielectric materials of BaO—TiO2 system providing relative dielectric constant ∈γ of 37 is used in the dielectric resonator 10 of the present example.

For manufacturing the dielectric resonator 10 of the present example, three ridge portions sharing one point of a dielectric block consisting of a cube with a side of 22 mm (22 mm×22 mm×22 mm) are chamfered in order to offer an angle of 45 degrees to the surface of the dielectric block and each surface of A1, A2, A3 and each surface of A1, A2, A3 is formed in plane having a width of approximately 7 mm respectively, as shown in FIG. 17(*a*). As a result, there are portions of the three surfaces of the original cube remained non-chamfered and a surface B1 adjacent to the surfaces A2, A3, a surface B2 adjacent to the surfaces A1, A3 and a surface BS adjacent to the surfaces A1, A2 are respectively formed. The surfaces B1, B2, B3 are squares with a side of 17 mm (17 mm×17 mm). Therefore, in the present example, area ratios of the surfaces A1, A2, A3 with respect to the surfaces B1, B2, B3 respectively are approximately 45%.

Further, as shown in FIG. 17, each of surfaces C (surface C2 opposing to surface B1, surface C1 opposing to surface B3, surface C3 opposing:to surface B2) opposing to the surfaces B is shaped in a square with a side of 22 mm (22 mm×22 mm) having one corner clipped by an isosceles triangle with two sides of 5 mm and one side of 7 mm. Though the portion in which the surfaces A (A1, A2, A3) transposition is formed in a triangular cone, there is no problem in the characteristic to chamfer the triangular cone portion to be plane.

Figure 18:
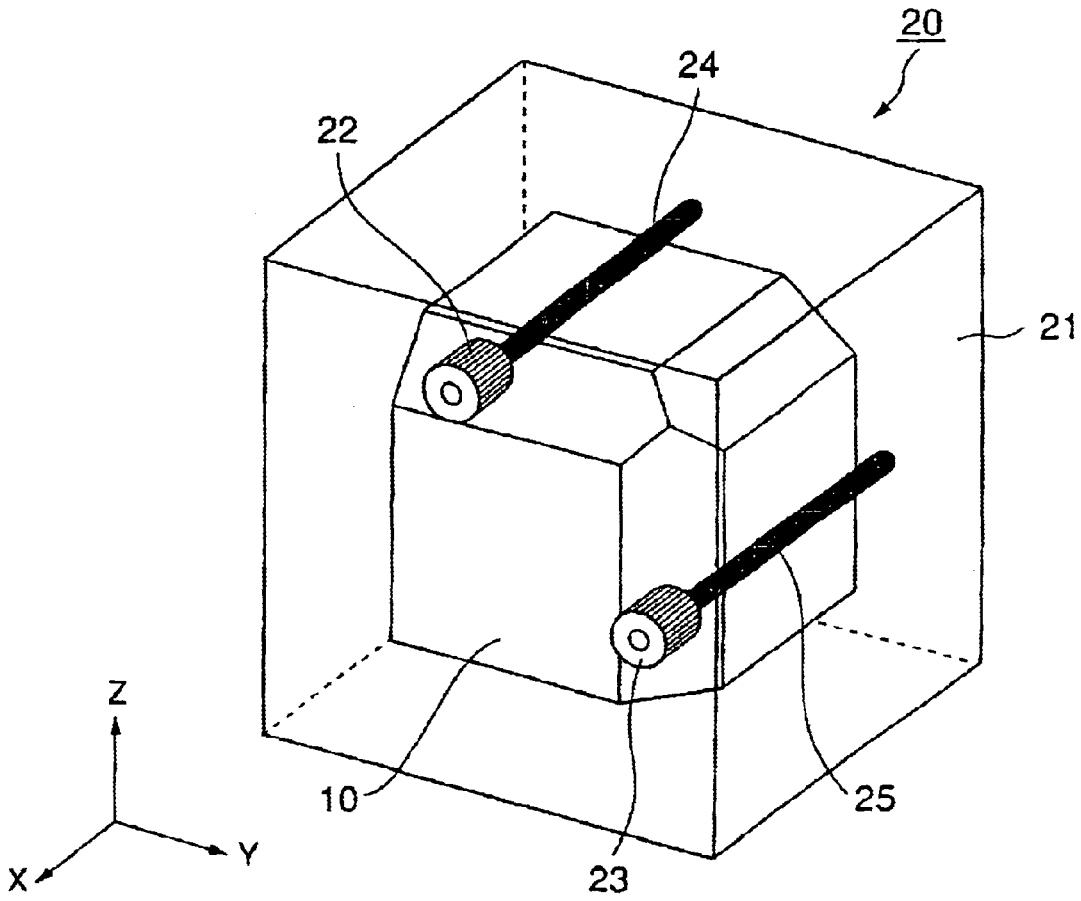
FIG. 18 is a diagram for showing a composition of the dielectric filter mounting a dielectric resonator of the example 1 therein.

FIG. 18 is a diagram for illustrating a dielectric filter 20 mounting the dielectric resonator 10 of the example 1 in a cut-off waveguide 21 of a generally rectangular parallelopiped. Incidentally, though axes x, y, z are shown separately from the dielectric resonator 10 in FIG. 18, each of axes x, y, z is in relation orthogonal to each of two surfaces of the dielectric block of the original cube of the dielectric resonator 10. The same thing takes place in the following drawings. The dielectric filter 20 is formed by disposing the dielectric resonator 10 shown in FIGS. 17(*a*) and (*b*) in a cut-off waveguide 21 of a generally rectangular parallelopiped which is manufactured by processing copper (Cu) plates with thickness of 1 mm or by grinding aluminum (Al) block to be with thickness of 3 mm. Incidentally, as shown in FIG. 18, the dielectric filter 20 provides feeding probes 22, 23 disposed at two positions therein. A rod-type material is used as feeding probes 24, 25. Direction p (not shown) of the two feeding probes 24 and 25 is parallel to the axis x with respect to axes x, y, z of the dielectric resonator 10, therefore, an angle p' (not shown) offered by the feeding probes 24 and 25 is 0 degree.

Figure 19:
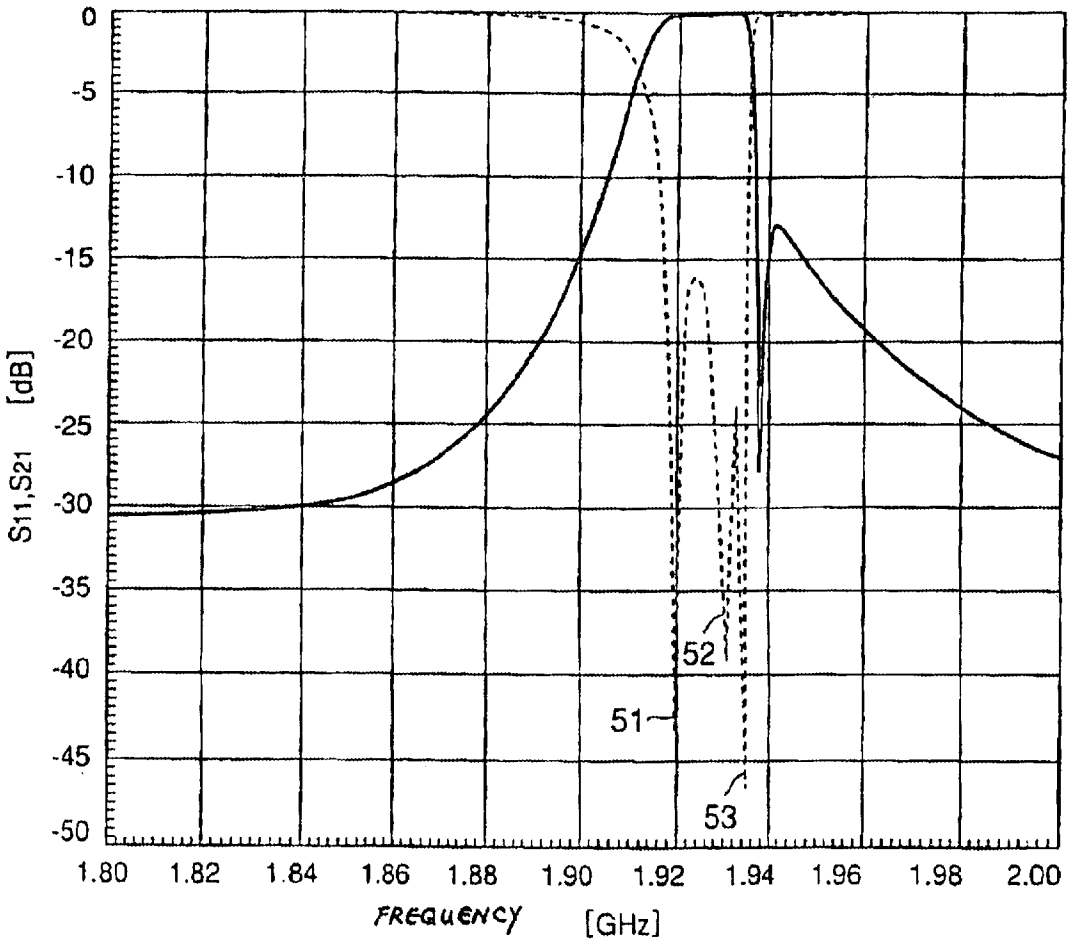
FIG. 19 is showing pass band characteristics and return loss of a dielectric filter shown in FIG. 18.

In FIG. 19, pass band characteristics of the dielectric filter 20 is indicated by a solid line and return loss is indicated by a dotted line, respectively.

As shown in FIG. 19, dielectric filter 20 of the present example has a pass band between 1.916 [GHz] and 1.934 [GHz], both inclusive. Further, in FIG. 19, poles of return loss 51, 52, 53 indicate that a three-stage band pass filter is formed by the dielectric filter 20 of the present example.

EXAMPLE 7

Figure 20:
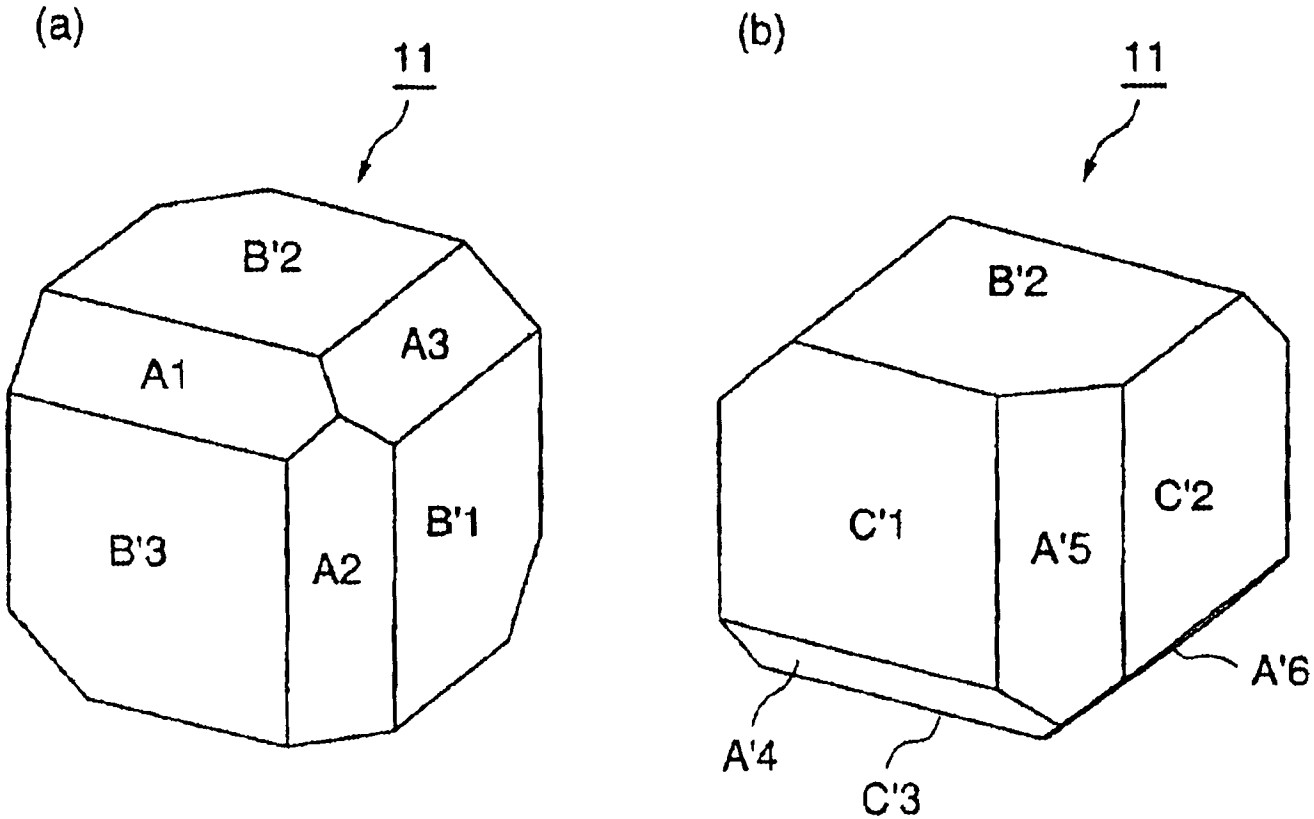
FIG. 20 is a diagram for showing a dielectric resonator of the example 2, (a) is a perspective view of the dielectric resonator observed from a certain point of view and (b) is a perspective view of the dielectric resonator observed from another point of view.

A dielectric resonator 11 of the present example is shown in FIGS. 20(*a*) and (*b*). FIGS. 20(*a*) and (*b*) are diagrams of the same dielectric resonator 11 observed from different points of view respectively. Incidentally, a dielectric block consists of dielectric material of BaO—TiO2 system providing relative dielectric constant ∈γ of 37 is used in the dielectric resonator 10 of the present example in the same manner as the example 1.

The dielectric resonator 11 of the present example has three surfaces A (A1, A2, A3) formed by chamfering three ridge portions sharing one point of a dielectric block, as shown in FIG. 20(*a*) and three surfaces A'4, A'5, A'6 (hereafter called surfaces A') further formed by chamfering three ridge portions sharing another point on diagonal line of the above-mentioned point. And in the present example, an angle offered by the three surfaces A or by three surfaces A' with other adjacent three surfaces B'1, B'2, B'3 [refer to FIG. 20(*a*)] (hereafter called as surfaces B') or with other adjacent three surfaces C'1, C'2, C'3 [refer to FIG. 20(*b*)] (hereafter called as surfaces 'C) respectively is 45 degrees.

For manufacturing a dielectric resonator 11 of the present example, three ridge portions sharing one point of a dielectric block consisting of a cube with a side of 22 mm (22 mm×22 mm×22 mm) is chamfered so that the surface of the dielectric block and surfaces A1, A2, A3 offers 45 degrees respectively and each of the surfaces A1, A2, A3 is formed in plane with a width of 7 mm, as shown in FIG. 20(*a*).

Further, three ridge portion sharing another point on a diagonal line of the above-mentioned point is chamfered so that the surface of the .dielectric block and surfaces A4', A5', A6' offers 45 degrees respectively and each of the surfaces A4', A5', A6' is formed in plane with a width of 7 mm, as shown in FIG. 20(*b*). As the result, there are portions of the three surfaces of the original cube remained un-chamfered, a surface B'1 adjacent to the surfaces A2, A3, a surface B'2 adjacent to the surfaces A1, A3 and a surface B'3 adjacent to the surfaces A1, A2 are respectively formed and a surface C'1 opposing to the surface B'3, a surface C'2 opposing to the surface B'1 and a surface C'3 opposing to the surface B'2 are formed respectively. The surfaces B'1, B'2, B'3 are squares with a side of 17 mm (17 mm×17 mm) chamfered by one corner thereof. As the result that the corner of the surfaces B'1, B'2, B'3 is chamfered, the area ratio of the surfaces A with respect to the surfaces B' is approximately 48% in the present example, which gets slightly larger than the above-mentioned example 1. And the areas and forms of the surfaces C' opposing to the surfaces B' are similar to the surfaces B'.

A similar dielectric filter can be formed by mounting the dielectric resonator 11 of the present example 7 in a cut-off waveguide of a generally rectangular parallelopiped, in the same manner as the example 6.

EXAMPLE 8

Figure 21:
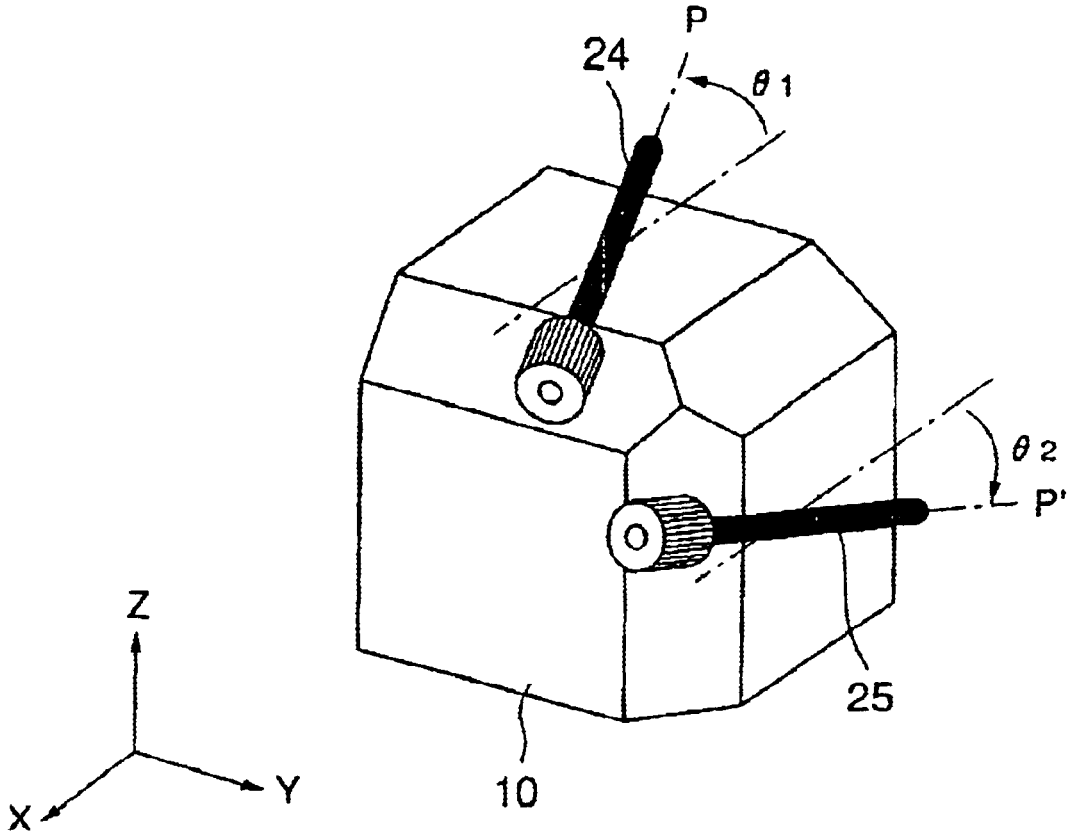
FIG. 21 is a diagram for showing a relation between a dielectric resonator and a feeding probe of the example 3.

A main portion of a dielectric filter of the present example is shown in FIG. 21. The dielectric filter of the present example is a dielectric filter mounting the dielectric resonator 10 similar to the one of example 6 shown in FIGS. 17(*a*) and (*b*) in a cut-off waveguide if a generally rectangular parallelopiped, but only the dielectric resonator 10 and feeding probes 24 and 25 are shown in FIG. 21.

In the event that a direction p of the feeding prove 24 with respect to the axes x, y, z of the dielectric resonator 10 swings on a x-y surface and an angle θ1 is 0 degree when the direction p is parallel to the axis x, the direction p can be varied within the range between −45 degrees and +45 degrees, both inclusive, and in the event that a direction p' of the feeding prove 25 swings on a z-x surface and an angle θ2 is 0 degree when the direction p' is parallel to the axis x, the direction p' can be varied within the range between −45 degrees and +45 degrees, both inclusive. Incidentally, the angles are adjusted as θ1=5 degrees, θ2=8 degrees respectively in the present example.

EXAMPLE 9

Figure 22:
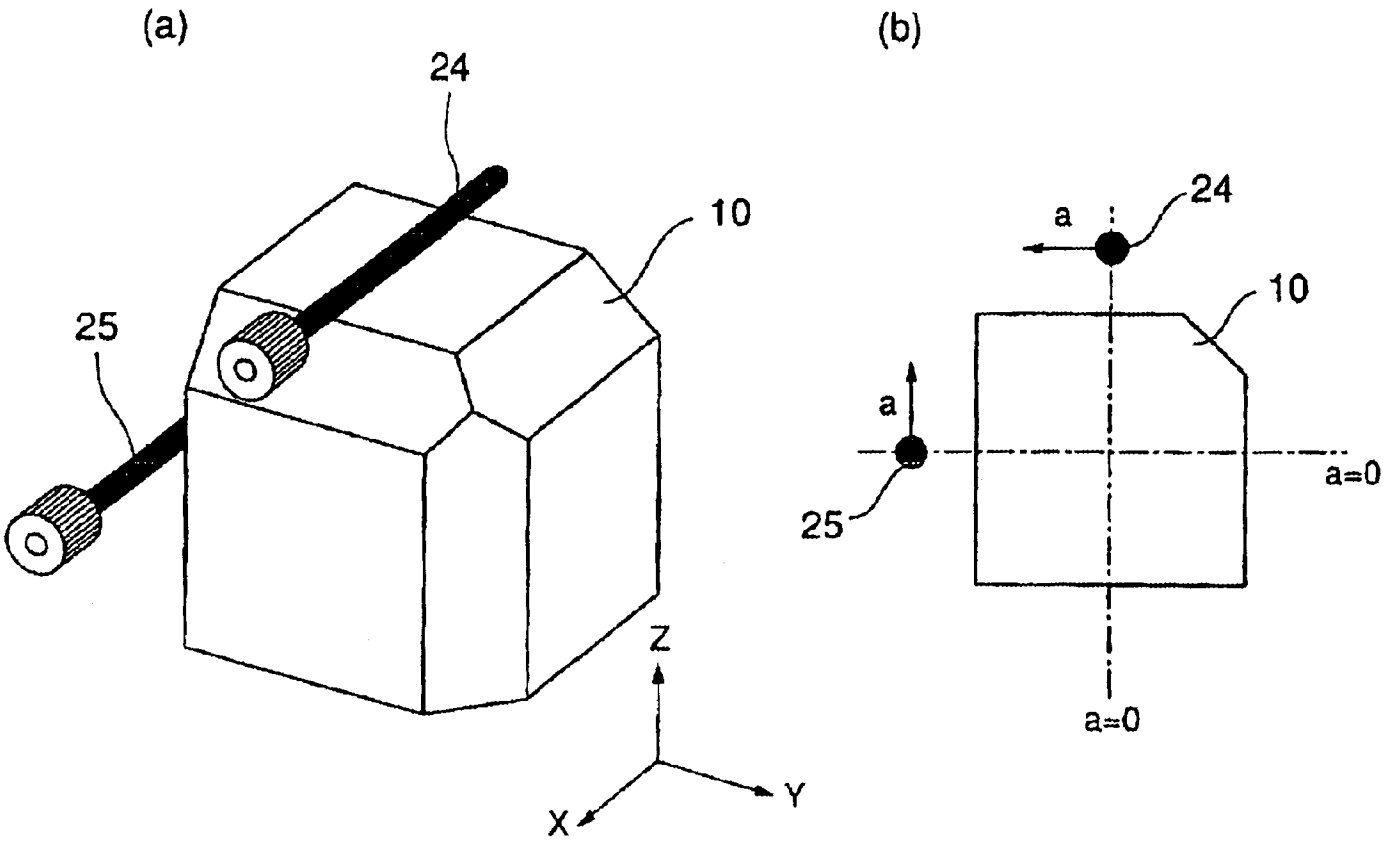
FIG. 22 is a diagram for showing a relation between a dielectric resonator and a feeding probe of an example 4, (a) is a diagram for showing main portion of the dielectric filter of the example 4 and (b) is a diagram for showing an installing position of the feeding probe.

A main portion of a dielectric filter of the present example is shown in FIG. 22(*a*). The dielectric filter of the present example is a dielectric filter mounting the dielectric resonator 10 similar to the one of example 6 shown in FIGS. 17(*a*) and (*b*) in a cut-off waveguide of a generally rectangular parallelopiped, but only the dielectric resonator 10 and feeding probes 24 and 25 are shown in FIG. 22(*a*).

In the present example, the feeding probes 24 and 25 are provided on the surfaces B [the surfaces B2 in FIG. 17(*a*)] and the surfaces C [the surfaces C2 in FIG. 17(*b*)] of the dielectric resonator 10. Positions for disposing the feeding probes 24 and 25 are shown in FIG. 22(*b*). FIG. 22(*b*) is a diagram of the dielectric resonator 10 and the feeding probes 24 and 25 observed from a direction of axis x. Directions p (not shown) and p' (not shown) of the feeding probes 24 and 25 are parallel to the axis x, as shown in FIG. 22(*b*) and the feeding probes 24 can be displaced in parallel with the axis y and the feeding probes 25 can be displaced in parallel with the direction of axis z, as shown in FIG. 22(*b*).

In FIG. 22(*b*), movement of the feeding probes 24 and 25 to approach to each other is indicated as a (refer to the diagram). Here, as shown in FIG. 22(*b*), the amount is indicated as a=0 in the event that the feeding probes 24 and 25 are positioned respectively on a centerline of the dielectric resonator 10.

Figure 23:
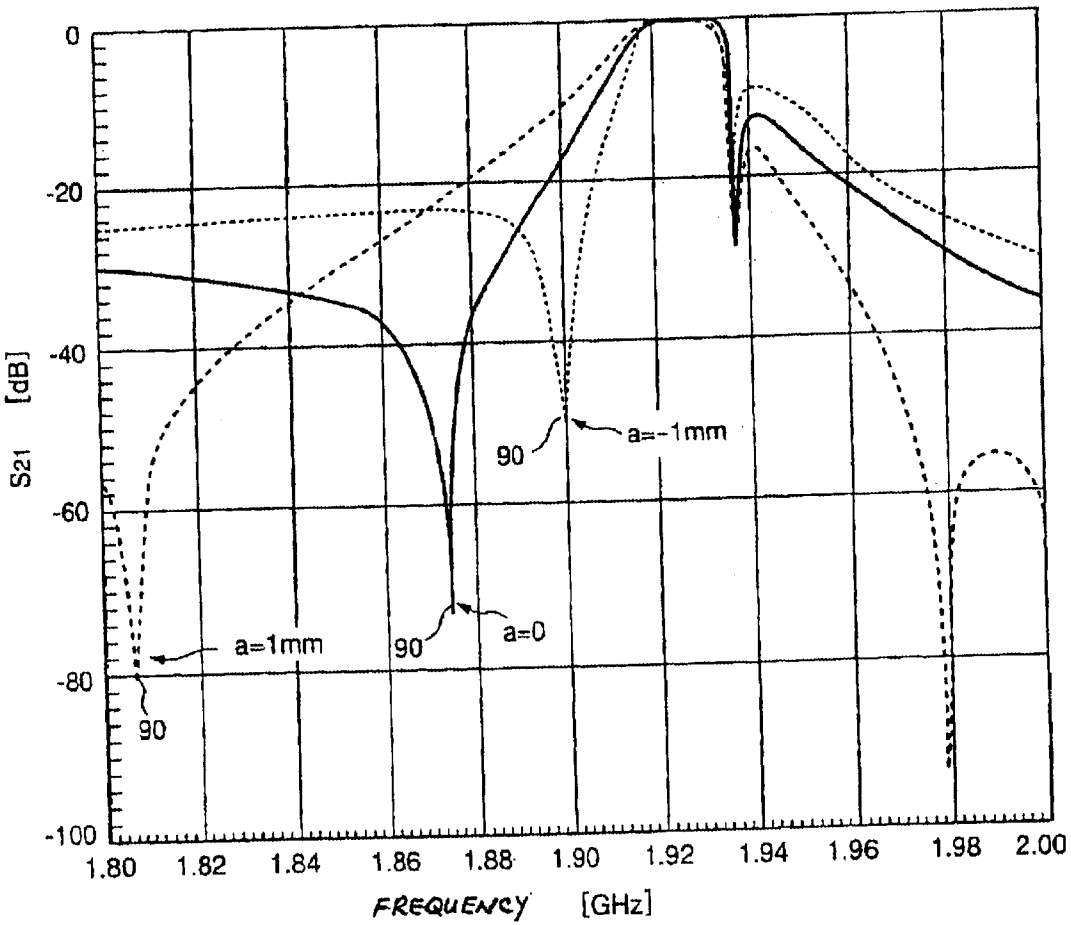
FIG. 23 is a diagram for showing attenuation characteristics of the dielectric filter of the example 4 and FIG. 24 is a diagram for illustrating an event of using plural dielectric resonators, (a) is a diagram for showing an example 5 using two dielectric resonators and (b) is a diagram for showing an example 6 applying four dielectric resonators to a duplexer.

In the present example, attenuation characteristics are measured in the following three events that the feeding probes 24 and 25 are positioned respectively on the center line of the dielectric resonator 10 [a=0], that the feeding probes 24 and 25 move 1 mm in a direction of approaching to each other [a=1] and that the feeding probes 24 and 25 move 1 mm in a direction of leaving to each other [a=−1]. In FIG. 23, the attenuation characteristics of the dielectric filter of the present example are shown. At first, as shown in the diagram, in the event of a=0, an attenuation pole 90 is generated at frequency of approximately 1.873 [GHz]. Thus, the attenuation pole is obtained on a side of lower frequency than a center frequency, that is, on a lower side band. And it is appeared that in the event that the feeding probes 24 and 25 move in the direction of approaching 1 mm to each other [a=1 mm], the attenuation pole 90 is generated at a frequency of approximately 1.806 [GHz], that is, it moves to the side of lower frequency, comparing to the event of a=0. On the contrary, in the event that the feeding probes 24 and 25 move in the direction of leaving 1 mm to each other [a=−1 mm], the attenuation pole 90 is generated at a frequency of approximately 1.90 [GHz], that is, it moves to the higher frequency side, comparing to the event of a=0.

EXAMPLE 10

Figure 24:
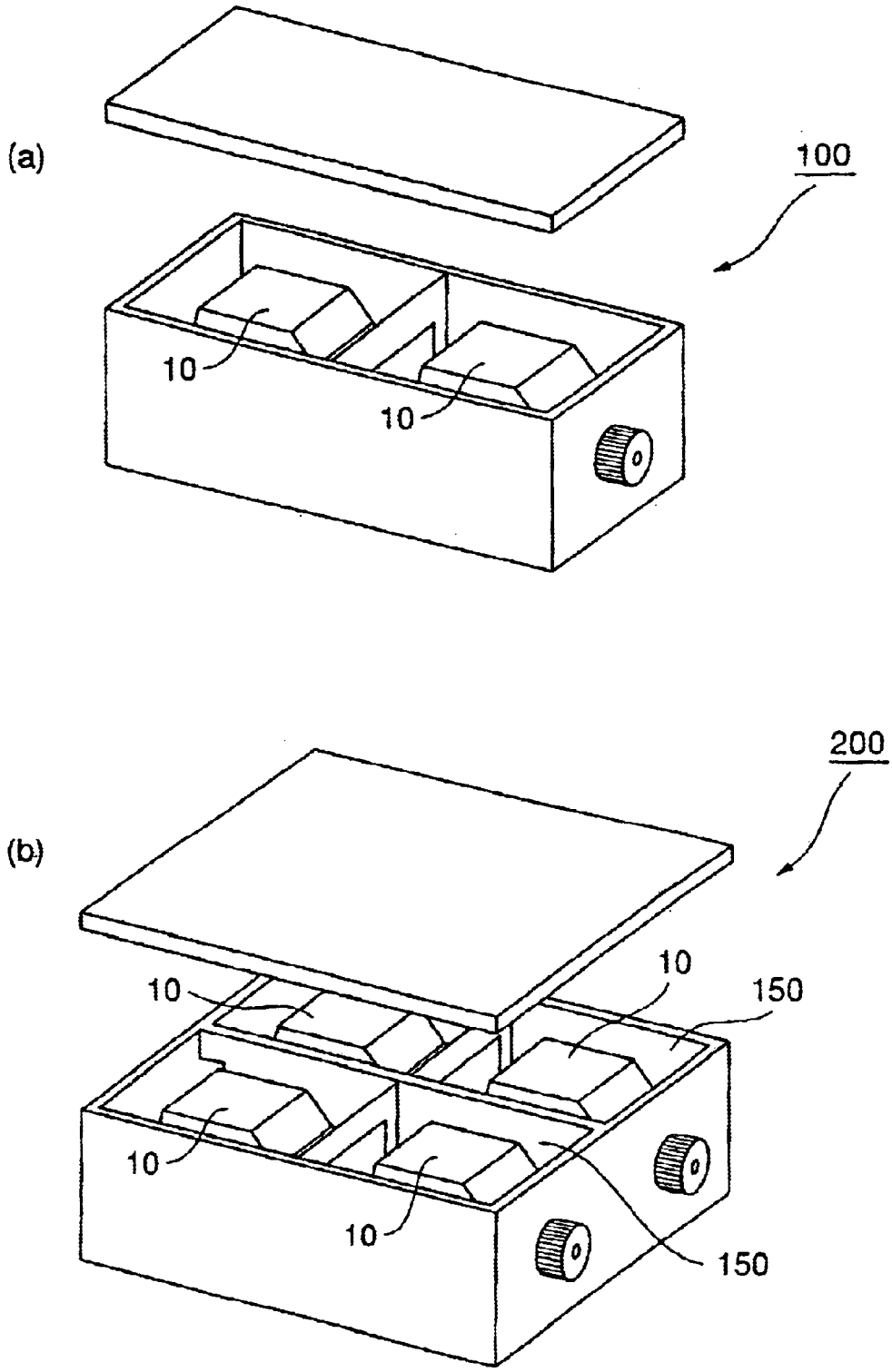

In the examples 6 through 9 above, examples using only one dielectric resonator are described, but in the present example, as shown in FIG. 24, two of the dielectric resonators 10 are used and a dielectric filter 100 with six stages are formed. At the time, there are two feeding probes and the characteristics thereof can he varied in the same manner as described in the examples 8 and 9.

And though it is not shown in the diagram, it is also acceptable to use three or more dielectric resonators 10 and the characteristics of the dielectric filter can be varied by varying the position or angle of the feeding probe.

EXAMPLE 11

The present example is an example using four dielectric resonators 10, as shown in FIG. 24(*b*). The present example is an example for applying a dielectric filter 150 combined for transmitting and for receiving using two dielectric resonators 10 and a duplexer 200 is composed.

While specific preferred embodiments of the present invention have been described above, it will be understood that the present invention is not limited and can be applied to other preferred embodiments within the scope of invention claimed therein.

For example, though a rod-type antenna is used as a feeding probe within the examples 6 though 9, the similar effect can be obtained by using loop antenna instead.

And though the angle offered by the three surfaces A formed by chamfering three ridge portions sharing one point of the dielectric block and another three surfaces B or B' adjacent thereto is set at 45 degrees, the similar effect can be obtained by an angle in the range between 40 degrees and 50 degrees, both inclusive. Further, though the angle offered by the three surfaces A' formed by chamfering three ridge portions sharing an apex of the dielectric block and another three surfaces C' adjacent thereto is set at 45 degrees, the similar effect can be obtained by an angle within the range between 40 degrees and 50 degrees, both inclusive.

Further more, though the area ratio of the surfaces A with respect to the surfaces B is set 45%, the similar effect can be obtained by an area ratio within the range between 1% and 200%, both inclusive.

INDUSTRIAL USABILITY

According to a first preferred embodiment of the present invention, it is possible to realize a triple mode dielectric resonator which is capable of acting as three resonators with one dielectric block, as described above. And by using the triple mode dielectric resonator, it is possible to achieve size reduction of dielectric filters. In the result of size reduction, weight and the number of required resonator can be reduced and the cost can be saved consequently. Besides, it is also effective for an arbitral positioning of an attenuation pole avoiding undesired resonance, and the like.

Further, as a dielectric resonator relative to a second preferred embodiment of the present invention has a dielectric block formed by chamfering three ridge portion of a generally rectangular parallelopiped and effects a degenerate coupling of the triple mode (TE01 δ mode) of the equal resonant frequency generated on three surfaces which are electro-magnetically independent of the above-mentioned dielectric block, it is possible for a very small dielectric resonator with a simple composition to be realized easily, while resonance of triple mode is available. And by mounting the dielectric resonator relative to the second preferred embodiment of the present invention, for example, in a cut-off waveguide of a generally rectangular parallelopiped and providing a feeding probe therein, a small sized dielectric filter with a simple composition can be provided.

What is claimed is:

1. A dielectric resonator in which three resonant modes of a dielectric block of a generally rectangular parallelopiped are coupled, wherein said block has three planes formed by chamfering three ridge portions of said dielectric block, respectively, said three chamfered ridges not being parallel to each other.

2. A dielectric resonator claimed in claim 1 characterized in that said dielectric block is mounted in a cut-off waveguide of a generally rectangular parallelopiped.

3. A dielectric resonator as claimed in claim 1, wherein said dielectric block further has a second set of three planes formed by chamfering another three ridge portions of said dielectric block, each said chamfered ridge of said second set of three chamfered ridges being opposite a respective one of said three chamfered ridges.

4. A dielectric resonator as claimed in claim 1, wherein said three resonant modes are $TE_{01\delta}$ modes.

5. A dielectric filter described by claim 1, further comprising:

a feeding probe, wherein said feeding probe is loop-type.

6. A dielectric resonator comprising a dielectric block in the form of a generally rectangular parallelopiped having three-ridge portions chamfered thereof and generating TE01 δ mode on electro-magnetically independent three surfaces of said dielectric block and having three surfaces of A1, A2, A3 (hereafter called surfaces A) formed by chamfering three ridge portions sharing a point of said dielectric block and three surfaces of B1, B2, B3 (hereafter called surfaces B) adjacent to each of the surfaces A respectively, in which an angle between 40 degrees and 50 degrees, both inclusive, is offered by said surfaces A and said surfaces B and an area ratio of said surfaces A with respect to said surfaces B and an area ratio of said surfaces A with respect to said surfaces B stands between 1% and 200%, both inclusive.

7. A dielectric filter using the dielectric resonator claimed in claim 6, further comprising a feeding probe, characterized in that an angle offered by a direction p and p' of the feeding probe with respect to the x, y, z axes of said dielectric resonator are variable within the range between −45 degrees and +45 degrees, both inclusive, while in use.

8. A dielectric filter using the dielectric resonator claimed in claim 6 characterized in having said three surfaces A formed by chamfering three ridge portions sharing an apex of said dielectric block, another three surfaces B adjacent to said three surfaces A offering an angle between 40 degrees and 50 degrees, both inclusive, and three surfaces C opposing to said three surfaces B respectively, wherein a feeding probe is provided on the surfaces B and surfaces C.

9. A dielectric filter claimed in claim 8 characterized in that frequency and attenuation generating the attenuation pole at lower side band can be varied by varying a position for providing a feeding probe on said surface B and a position for providing a feeding probe on said surfaces C.

10. A dielectric filter claimed in claim 8, 7, or 9, wherein said feeding probe comprises a rod-type feeding probe.

11. A dielectric resonator comprising a dielectric block in the form of a generally rectangular parallelopiped having three-ridge portions chamfered thereof and generating TE01 δ mode on electro-magnetically independent three surfaces of said dielectric block and having three surfaces A1, A2, A3 (hereafter called surfaces A) formed by chamfering three ridge portions sharing an apex of said dielectric block, another three surfaces of A'4, A'5, A'6 (hereafter called surfaces A') formed by chamfering three ridge portions sharing another apex on a diagonal line of said apex, another three surfaces of B'1, B'2, B'3 (hereafter called surfaces B') adjacent to each of surfaces A and surfaces A' respectively and still another three surfaces of C'1, C'2, C'3 (hereafter called surfaces C') adjacent to each of surfaces A and surfaces A' respectively, wherein an angle of 40 degrees through 50 degrees is offered by the surfaces A and B' or by the surfaces A' and C' and an area ratio of said surfaces A with respect to surfaces B' or an area ratio of said surfaces A' with respect to said surfaces C' stand between 1% and 200% both inclusive, respectively.

12. A dielectric filter using the dielectric resonator claimed in claim 2, 6, or 11, further comprising at least two or more of said dielectric resonators in said cut-off waveguide of a generally rectangular parallelopiped.

13. A dielectric filter using the dielectric resonator claimed in claim 6 or 9 characterized in that an angle between 40 degrees and 50 degrees, both inclusive, is offered by said three surfaces A or A' formed by chamfering three ridge portion sharing an apex of said dielectric block and other three surfaces B or B' adjacent thereto respectively and the surfaces A or A' and surfaces B or B' adjacent thereto respectively have three opposing surfaces of C1, C2, C3 (hereafter called surfaces C) or the surfaces C' and characterized in providing a feeding probe near the surface B and B', the surfaces B' and B', the surfaces C and C', or the surfaces C' and C'.

14. A dielectric filter of claim 13, wherein said feeding probe comprises a rod-type feeding probe.

15. A dielectric resonator comprising:

a dielectric block having a generally rectangular parallelopiped shape, wherein two edges of said dielectric block are chamfered in a manner to provide a coupling of three resonant modes of said dielectric block, wherein a first chamfered edge is parallel to a y-axis, a second chamfered edge is parallel to a z-axis, and said first chamfered edge does not intersect said second chamfered edge.

16. A dielectric filter characterized in disposing at least one dielectric resonator claimed in claim 15 in a cut-off waveguide.

17. A dielectric filter claimed in claim 16, further comprising a second resonator in said cut-off waveguide, said second resonator being a type different than that described in claim 1.

18. A dielectric filter claimed in claim 16 characterized in installing another resonator further than said dielectric resonator in said cut-off waveguide.

19. A dielectric filter claimed in claim 16 characterized in disposing a metal rod contacting with said cut-off waveguide by one end in parallel with a side surface of said dielectric resonator in the position distant by a predetermined amount from said side surface and having a composition in which resonant frequency of each resonance and an amount of coupling between resonance is adjustable.

20. A dielectric filter claimed in claim 19 characterized in installing another resonator further than said dielectric resonator in said cut-off waveguide.

21. A dielectric filter claimed in claim 16 characterized in disposing two or more of said dielectric resonators in said cut-off waveguide and providing a partition comprising a conductive material between said dielectric resonators.

22. A dielectric filter claimed in claim 21 characterized in disposing a metal rod contacting with said cut-off waveguide b one end in parallel with a side surface of said dielectric resonator in the position distant by a predetermined amount from said side surface and having a composition in which resonant frequency of each resonance and an amount of coupling between resonators is adjustable.

23. A dielectric filter claimed in claim 21 characterized in installing another resonator further than said dielectric resonator in said cut-off waveguide.

24. A dielectric resonator comprising:

a dielectric block having a generally rectangular parallelopiped shape, wherein three resonant modes of said dielectric block are coupled, said dielectric resonator has a first plane formed by chamfering a single one of a ridge portion of said dielectric block and a second plane formed by chamfering a single one of a second ridge portion of said dielectric block, said first chamfered ridge portion not being parallel to said second chamfered ridge portion, and no other ridge portion in said dielectric block is chamfered.

25. The dielectric resonator of claim 24, wherein a coupling amount of said three resonant modes of said dielectric block is varied by changing dimensions of said first plane and dimension of said second plane.

26. A dielectric resonator, comprising:

a dielectric block having a generally rectangular parallelepiped shape, wherein three resonant modes of said dielectric block are coupled, wherein said dielectric resonator has a first plane formed by chamfering a single one of a ridge portion of said dielectric block and a second plane formed by chamfering a single one of a second ridge portion of said dielectric block, said first chamfered ridge portion not being parallel to said second chamfered ridge portion, said first chamfered ridge portion and said second chamfered ridge portion not crossing each other, said first chamfered ridge being parallel to a y-axis, said second chamfered edge being parallel to a z-axis.

27. A dielectric resonator, comprising:

a dielectric block having a generally rectangular parallelepiped shape, wherein three resonant modes of said dielectric block are coupled, wherein said dielectric resonator has a first plane formed by chamfering a single one of a ridge portion of said dielectric block and a second plane formed by chamfering a single one of a second ridge portion of said dielectric block, said first chamfered ridge portion not being parallel to said second chamfered ridge portion, said first chamfered ridge portion and said second chamfered ridge portion not crossing each other, and no other ridge portion in said dielectric block is chamfered, and wherein a coupling amount of said three resonant modes of said dielectric block is varied by changing dimensions of said first plane and said second plane, respectively.

28. A dielectric filter, comprising:

at least one dielectric resonator including a dielectric block having a generally rectangular parallelepiped shape, wherein three resonant modes of said dielectric block are coupled, wherein said dielectric resonator has a first plane formed by chamfering a single one of a ridge portion of said dielectric block and a second plane formed by chamfering a single one of a second ridge portion of said dielectric block, said first chamfered ridge portion not being parallel to said second chamfered ridge portion, said first chamfered ridge portion being parallel to a y-axis, said second chamfered edge being parallel to a z-axis; and a waveguide, wherein said at least one dielectric resonator is located in said waveguide.

29. A dielectric filter of claim 28, wherein said at least one dielectric resonator comprises a dielectric resonator of a first type, said dielectric filter further comprising:

a dielectric resonator of a second type, said second type dielectric resonator being coupled to said at least one of said first type dielectric resonator.

30. The dielectric filter of claim 29, wherein said second type dielectric resonator has a TEM mode and comprises a metal.

31. The dielectric filter of claim 28, further comprising:

a partition comprising a conductive material separating two dielectric resonators in said waveguide.

32. The dielectric filter of claim 28, further comprising:

a metal rod inserted between two dielectric resonators in said waveguide.

33. The dielectric filter of claim 28, further comprising:

an exciting means as an input terminal; and an exciting means as an output terminal.

34. The dielectric filter of claim 33, wherein each of said exciting means comprises a rod-shaped antenna of which a head portion is open.

35. A dielectric filter, comprising:

at least one dielectric resonator including a dielectric block having a generally rectangular parallelepiped shape, wherein three resonant modes of said dielectric block are coupled, wherein said dielectric resonator has a first plane formed by chamfering a single one of a ridge portion of said dielectric block and a second plane formed by chamfering a single one of a second ridge portion of said dielectric block, said first chamfered ridge portion not being parallel to said second chamfered ridge portion;

a metal rod inserted near one of said at least one dielectric resonator, wherein each resonant frequency of each said resonant modes and each coupling amount between said three resonant modes are adjusted by adjusting a length of said metal rod; and a waveguide, wherein said at least one dielectric resonator is located in said waveguide.

36. A dielectric filter, comprising:

at least one dielectric resonator including a dielectric block having a generally rectangular parallelepiped shape, wherein three resonant modes of said dielectric block are coupled, wherein said dielectric resonator has a first plane formed by chamfering a single one of a ridge portion of said dielectric block and a second plane formed by chamfering a single one of a second ridge portion of said dielectric block, said first chamfered ridge portion not being parallel to said second chamfered ridge portion and no other ridge portion in said dielectric block is chamfered;

a waveguide, wherein said at least one dielectric resonator is located in said waveguide; and a dielectric member having a low dielectric constant, said dielectric member supporting said at least one dielectric resonator.

37. A dielectric resonator comprising:

a dielectric block having a generally rectangular parallelopiped shape;

a first chamfered edge on said dielectric block, said first chamfered edge being parallel to an x-axis of said block;

a second chamfered edge on said dielectric block, said second chamfered edge being parallel to a y-axis of said block; and a third chamfered edge on said dielectric block, said second chamfered edge being parallel to a z-axis of said block, wherein said first, second, and third chamfered edges mutually intersect in a first corner of said dielectric block.

38. The dielectric resonator of claim 37, further comprising:

a fourth chamfered edge on said dielectric block, said fourth chamfered edge also being parallel to said x-axis;

a fifth chamfered edge on said dielectric block, said fifth chamfered edge also being parallel to said y-axis; and a sixth chamfered edge on said dielectric block, said sixth chamfered edge also being parallel to said z-axis, wherein said fourth, fifth, and sixth chamfered edges mutually intersect in a second corner of said dielectric block, said second corner being diagonally opposite said first corner.

39. A dielectric filter comprising:

at least one dielectric resonator including a dielectric block having a generally rectangular parallelepiped shape, wherein three resonant modes of said dielectric block are coupled; and a waveguide containing said at least one dielectric resonator, wherein said dielectric resonator comprises one of the following three configurations:

said dielectric resonator has a first plane formed by chamfering a single one of a ridge portion of said dielectric block and a second plane formed by chamfering a single one of a second ridge portion of said dielectric block, said first chamfered ridge portion not being parallel to said second chamfered ridge portion, said first chamfered ridge portion and said second chamfered ridge portion not crossing each other, and no other ridge portion in said dielectric block is chamfered;

said dielectric resonator has a first chamfered edge being parallel to an x-axis of said block, a second chamfered edge being parallel to a y-axis of said block, and a third chamfered edge on said dielectric block being parallel to a z-axis of said block, said first, second, and third chamfered edges mutually intersecting in a corner of said dielectric block; and said dielectric resonator has said first chamfered edge, said second chamfered edge, and said third chamfered edge intersecting in a first corner of said dielectric block, said dielectric resonator further having a fourth chamfered edge also being parallel to said x-axis, a fifth chamfered edge also being parallel to said y-axis, and a sixth chamfered edge on said dielectric block, said sixth chamfered edge also being parallel to said z-axis, wherein said fourth, fifth, and sixth chamfered edges mutually intersect in a second corner of said dielectric block, said second corner being diagonally opposite said first corner.

40. A dielectric filter according to claim 39, wherein a partition is provided between said dielectric resonators, said partition being comprised of a conductive material.

41. A dielectric filter according to claim 40, further comprising:

a support member for each said dielectric resonator, said support member comprised of a material having a low dielectric constant.

42. A dielectric filter according to claim 39, further comprising:

a first metal rod inserted between two of said dielectric resonators; and a second metal rod inserted near at least one said dielectric resonator, a length of said second metal rod providing an adjustment for a resonant frequency of each said three resonant modes, said length of said second rod additionally providing an adjustment for an amount of coupling between said three resonant modes.

43. A dielectric filter according to claim 42, further comprising:

a support member for each said dielectric resonator, said support member comprised of a material having a low dielectric constant.

44. A dielectric filter according to claim 39, further comprising:

a support member for each said dielectric resonator, said support member comprised of a material having a low dielectric constant.

45. A dielectric filter according to claim 39, wherein a metal rod is inserted between said dielectric resonators.

46. A dielectric filter according to claim 39, further comprising:

an exciting means used as an input terminal; and an exciting means used as an output terminal.

47. A dielectric filter according to claim 46, wherein each said exciting means comprises a rod-shaped antenna of which a head portion is open.

48. A dielectric filter according to claim 46, further comprising:

a support member for each said dielectric resonator, said support member comprised of a material having a low dielectric constant.

49. A dielectric filter according to claim 47, further comprising:

a support member for each said dielectric resonator, said support member comprised of a material having a low dielectric constant.

50. A dielectric filter according to claim 45, further comprising:

a support member for each said dielectric resonator, said support member comprised of a material having a low dielectric constant.

51. A dielectric filter comprising:

a waveguide;

at least one dielectric resonator of a first type located in said waveguide, said first type being a dielectric resonator including a dielectric block having a generally rectangular parallelepiped shape, wherein three resonant modes of said dielectric block are coupled; and at least one dielectric resonator of a another type than said first type located in said waveguide, each said at least one dielectric resonator of another type being coupled to at least one of said at least one dielectric resonator of a first type, wherein said dielectric resonator comprises one of the following three configurations:

said dielectric resonator has a first plane formed by chamfering a single one of a ridge portion of said dielectric block and a second plane formed by chamfering a single one of a second ridge portion of said dielectric block, said first chamfered ridge portion not being parallel to said second chamfered ridge portion, said first chamfered ridge portion and said second chamfered ridge portion not crossing each other, and no other ridge portion in said dielectric block is chamfered;

said dielectric resonator has a first chamfered edge being parallel to an x-axis of said block, a second chamfered edge being parallel to a y-axis of said block, and a third chamfered edge on said dielectric block being parallel to a z-axis of said block, said first, second, and third chamfered edges mutually intersecting in a corner of said dielectric block; and said dielectric resonator has said first chamfered edge, said second chamfered edge, and said third chamfered edge intersecting in a first corner of said dielectric block, said dielectric resonator further having a fourth chamfered edge also being parallel to said x-axis, a fifth chamfered edge also being parallel to said y-axis, and a sixth chamfered edge on said dielectric block, said sixth chamfered edge also being parallel to said z-axis, wherein said fourth, fifth, and sixth chamfered edges mutually intersect in a second corner of said dielectric block, said second corner being diagonally opposite said first corner.

52. A dielectric filter according to claim 51, wherein a metal rod is inserted between said dielectric resonators.

53. A dielectric filter according to claim 51, wherein a partition is provided between said dielectric resonators, said partition being comprised of a conductive material.

54. A dielectric filter according to claim 51, further comprising:

an exciting means used as an input terminal; and an exciting means used as an output terminal.

55. A dielectric filter according to claim 51, further comprising:

a support member for each said dielectric resonator, said support member comprised of a material having a low dielectric constant.

56. A dielectric filter according to claim 51, further comprising:

a first metal rod inserted between two of said dielectric resonators; and a second metal rod inserted near at least one said dielectric resonator, a length of said second metal rod providing an adjustment for a resonant frequency of each said three resonant modes, said length of said second rod additionally providing an adjustment for an amount of coupling between said three resonant modes.

57. A dielectric filter according to claim 51, wherein at least one of said at least one dielectric of another type comprises a resonator having TEM mode and is comprised of a metal.

58. A dielectric filter according to claim 57, wherein a partition is provided between said dielectric resonators, said partition being comprised of a conductive material.

59. A dielectric filter according to claim 57, further comprising:

a support member for each said dielectric resonator, said support member comprised of a material having a low dielectric constant.

60. A dielectric filter according to claim 57, wherein a metal rod is inserted between said dielectric resonators.

61. A dielectric filter according to claim 57, further comprising:

an exciting means used as an input terminal; and an exciting means used as an output terminal.

62. A dielectric filter according to claim 57, further comprising:

a first metal rod inserted between two of said dielectric resonators; and a second metal rod inserted near at least one said dielectric resonator, a length of said second metal rod providing an adjustment for a resonant frequency of each said three resonant modes, said length of said second rod additionally providing an adjustment for an amount of coupling between said three resonant modes.

* * * * *